US007066118B2

(12) United States Patent
Hirano

(10) Patent No.: US 7,066,118 B2
(45) Date of Patent: Jun. 27, 2006

(54) COMPRESSION RATIO VARIABLE DEVICE IN INTERNAL COMBUSTION ENGINE

(75) Inventor: Makoto Hirano, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/480,422

(22) PCT Filed: Jun. 7, 2002

(86) PCT No.: PCT/JP02/05702

§ 371 (c)(1),
(2), (4) Date: Jun. 28, 2004

(87) PCT Pub. No.: WO02/103178

PCT Pub. Date: Dec. 27, 2002

(65) Prior Publication Data

US 2004/0231619 A1 Nov. 25, 2004

(30) Foreign Application Priority Data

| | | |
|---|---|---|
| Jun. 15, 2001 | (JP) | 2001-181295 |
| Feb. 25, 2002 | (JP) | 2002-048606 |
| Feb. 25, 2002 | (JP) | 2002-048607 |
| Feb. 25, 2002 | (JP) | 2002-048608 |

(51) Int. Cl.
*F02D 15/02* (2006.01)
*F02B 75/04* (2006.01)
*F02F 3/00* (2006.01)

(52) U.S. Cl. ..... 123/48 B

(58) Field of Classification Search ..... 123/48 R, 123/48 A, 48 AA, 48 B, 78 R, 78 A, 78 AA, 123/78 B, 78 BA, 78 E
See application file for complete search history.

(56) References Cited

U.S. PATENT DOCUMENTS

| | | | | |
|---|---|---|---|---|
| 4,241,705 | A * | 12/1980 | Karaba et al. | 123/78 B |
| 4,463,710 | A * | 8/1984 | McWhorter | 123/48 B |
| 4,515,114 | A | 5/1985 | Dang | |
| 4,785,790 | A * | 11/1988 | Pfeffer et al. | 123/78 B |
| 4,864,977 | A * | 9/1989 | Hasegawa | 123/48 B |
| 4,934,347 | A * | 6/1990 | Suga et al. | 123/78 B |
| 5,178,103 | A | 1/1993 | Simko | |
| 5,179,916 | A * | 1/1993 | Schonfeld | 123/48 B |
| 5,247,911 | A * | 9/1993 | Nenicka | 123/48 B |
| 5,257,600 | A * | 11/1993 | Schechter et al. | 123/78 B |

(Continued)

FOREIGN PATENT DOCUMENTS

| | | |
|---|---|---|
| GB | 762074 | 11/1956 |

(Continued)

*Primary Examiner*—Marguerite McMahon
(74) *Attorney, Agent, or Firm*—Birch,Stewart,Kolasch & Birch,LLP

(57) ABSTRACT

A compression ratio changing device in an internal combustion engine includes a piston inner element, a piston outer element slidably fitted over an outer periphery of the piston inner element for sliding movement only in an axial direction and capable of being moved between a lower-compression ratio position (L) and a higher-compression ratio position (H), a bulking member capable of being turned about axes of the piston inner and outer elements between a non-bulking position (A) and a bulking position (B), and an actuator connected to the bulking member for turning the bulking member to the non-bulking position (A) and the bulking position (B). The bulking member permits movement of the piston outer element to the lower-compression ratio position (L) when it is in the non-bulking position (A), and retains the piston outer element in the higher-compression ratio position (H), when it is turned to the bulking position (B).

53 Claims, 21 Drawing Sheets

U.S. PATENT DOCUMENTS 5,331,928 A * 7/1994 Wood ..... 123/78 B
5,476,074 A * 12/1995 Boggs et al. ..... 123/48 B

FOREIGN PATENT DOCUMENTS

JP 63-131839 A 6/1988
JP 63-143342 A 6/1988
JP 6-17665 A 1/1994
JP 6-212993 A 8/1994
JP 7-113330 B2 12/1995
JP 11-117779 A 4/1999

* cited by examiner

COMPRESSION RATIO VARIABLE DEVICE IN INTERNAL COMBUSTION ENGINE

FIELD OF THE INVENTION

The present invention relates to a compression ratio changing device in an internal combustion engine, and particularly, to an improvement in a compression ratio changing device in an internal combustion engine including a piston which is comprised of a piston inner element connected to a connecting rod through a piston pin, and a piston outer element which is connected to the piston inner element with an outer end face thereof exposed to a combustion chamber, the piston outer element capable of being moved between a lower-compression ratio position close to the piston inner element and a higher-compression ratio position close to the combustion chamber, so that the piston outer element is operated to the lower-compression ratio position to decrease the compression ratio of the engine and operated to the higher-compression ratio position to increase the compression ratio of the engine.

BACKGROUND ART

As conventional compression ratio changing devices in internal combustion engines, there are known (1) a compression ratio changing device in which a piston outer element is threadedly fitted over an outer periphery of a piston inner element, so that the piston outer element is advanced and retracted relative to the piston inner element to a lower-compression ratio position and a higher-compression ratio position by rotating and reversing the piston outer element (for example, see Japanese Patent Application Laid-open No.11-117779), and (2) a compression ratio changing device in which a piston outer element is axially slidably fitted over an outer periphery of a piston inner element, and an upper hydraulic pressure chamber and a lower hydraulic pressure chamber are defined between the piston inner and outer elements, so that the piston outer element is operated to a lower-compression ratio position and a higher-compression ratio position by supplying a hydraulic pressure alternately to the hydraulic pressure chambers (for example, see Japanese Patent Publication No. 7-113330).

It should be noted here that in the device (1), in order to operate the piston outer element to the lower-compression ratio position and the higher-compression ratio position, it is necessary to rotate the piston outer element. For this reason, the shape of a top face of the piston outer element cannot be determined freely in correspondence to the shape of a ceiling surface of a combustion chamber and the dispositions of intake and exhaust valves, and it is difficult to sufficiently increase the compression ratio of the engine in the higher-compression ratio position. In the device (2), particularly when the piston outer element is in the higher-compression ratio position, a large thrust load received by the piston outer element in an expansion stroke of the engine is supported by a hydraulic pressure in the upper hydraulic pressure chamber and hence, a seal withstanding a high pressure is required in the upper hydraulic pressure chamber. Moreover, when bubbles are produced in the upper hydraulic pressure chamber, the higher-compression ratio position of the piston outer element is unstable and hence, it is necessary to provide a means for removing such bubbles and as a result, an increase in cost as a whole is inevitable.

DISCLOSURE OF THE INVENTION

The present invention has been accomplished with such circumstances in view, and it is an object of the present invention to provide a compression ratio changing device in an internal combustion engine, wherein the piston outer element can be operated simply and precisely to the lower-compression ratio position and the higher-compression ratio position without being rotated.

To achieve the above object, according to a first aspect and feature of the present invention, there is provided a compression ratio changing device in an internal combustion engine, comprising a piston inner element connected to a connecting rod through a piston pin, a piston outer element which is fitted over an outer periphery of the piston inner element for sliding movement only in an axial direction with an outer end face thereof exposed to a combustion chamber, the piston outer element capable of being moved between a lower-compression ratio position close to the piston inner element and a higher-compression ratio position close to the combustion chamber, a bulking member interposed between the piston inner and outer elements and capable of being moved between a non-bulking position where the bulking member permits the movement of the piston outer element to the lower-compression ratio position, and a bulking position where the piston outer element is retained in the higher-compression ratio position, and an actuator for retaining the bulking member alternately in the non-bulking position and the bulking position.

With the first feature, when the bulking member is moved to the non-bulking position by the actuator, the bulking member permits the movement of the piston outer element to the lower-compression ratio position and hence, the piston outer element can be moved to the lower-compression ratio position by a high pressure from the combustion chamber. When the bulking member is moved from the non-bulking position to the bulking position by the actuator, the piston outer element can be retained in the higher-compression ratio position.

During this time, the piston outer element cannot be rotated relative to the piston inner element and hence, the shape of a top face of the piston outer element exposed to the combustion chamber can be formed in correspondence to the shape of the combustion chamber to effectively increase the compression ratio in the higher-compression ratio position of the piston outer element. Moreover, in the higher-compression ratio position of the piston outer element, a large thrust force received by the piston outer element from the combustion chamber in an expansion stroke of the engine is received by the bulking member. Therefore, the application of the thrust force to the actuator is avoided and hence, it is possible to achieve a decrease in output from the actuator and in its turn, the compactness of the actuator. Even when the actuator is constructed into a hydraulic type, a high-pressure seal is not required, because the thrust force is not applied to the actuator. In addition, even if some bubbles are produced in the hydraulic pressure chamber, the higher-compression ratio position of the piston outer element cannot be made unstable.

According to a second aspect and feature of the present invention, in addition to the first feature, the bulking member and the actuator are constructed so that the piston outer element is permitted to be moved, during reciprocal movements of the piston inner and outer elements, between the lower-compression ratio position and the higher-compression ratio position by natural external forces applied to the piston inner and outer elements to move these elements axially away from and toward each other. The natural external forces include a friction resistance received from an inner surface of a cylinder bore by the piston outer element, an inertia force of the piston outer element, an intake negative pressure applied to the piston outer element and the like.

With the second feature, the natural external forces can be utilized to move the piston outer element from the lower-compression ratio position to the higher-compression ratio position or from the higher-compression ratio position to the lower-compression ratio position. Therefore, if the actuator exhibits an output enough to merely move the bulking member between the non-bulking position and the bulking position, it suffices and hence, it is possible to provide reductions in capacity and size of the actuator.

According to a third aspect and feature of the present invention, in addition to the first or second feature, the bulking member is interposed between the piston inner and outer elements so as to be capable of turning about axes of the piston inner and outer elements between the non-bulking position and the bulking position, and a first cam and a second cam are formed into a convex shape on axially opposed surfaces of the bulking member and one of the piston inner and outer elements, and have slants for slipping on each other axially away from each other, when the bulking member is turned from the non-bulking position to the bulking position, and flat top faces for abutting against each other, when the bulking member has reached the bulking position.

With the third feature, when the bulking member is turned from the non-bulking position to the bulking position, the first and second cams are moved axially away from each other, while their slants are slipped on each other. Therefore, the piston outer element can be pushed up to the higher-compression ratio position. Moreover, when the bulking member has reached the bulking position, the flat top faces of the first and second cams are put into abutment against each other and hence, a large thrust force received from the combustion chamber by the piston outer element is applied vertically to the flat top face during an expansion stroke of the engine and can be reliably prevented from being applied as a turning torque to the bulking member.

According to a fourth aspect and feature of the present invention, in addition to the second feature, the bulking member is interposed between the piston inner and outer elements so as to be capable of turning about axes of the piston inner and outer elements between the non-bulking position and the bulking position, and a first cam and a second cam are formed into a convex shape on axially opposed surfaces of the bulking member and one of the piston inner and outer elements, and have flat top faces for abutting against each other, when the bulking member has reached the bulking position, and precipice faces extending downwards substantially vertically from circumferentially opposite side edges of the top faces to roots of the cams.

With the fourth feature, it is possible to set the operational stroke angle of the bulking member at a small value and to form each of the top faces of the cams in a large extent by forming the opposite sides of the first and second cams as the precipice faces. Thus, it is possible to enhance the responsiveness of the bulking member and to reduce the surface pressure applied to the top faces to enhance the durability of the top faces.

Moreover, in order to move the piston outer element between the lower and higher-compression ratio positions, the natural external forces for moving the piston inner and outer elements axially away from and toward each other are utilized and hence, the turning movement of the bulking member between the non-bulking position and the bulking position cannot be hindered.

According to a fifth aspect and feature of the present invention, in addition to any of the first to fourth features, a piston outer element locking means is provided between the piston inner and outer elements for locking the piston outer element relative to the piston inner element, when the piston outer element has reached the lower-compression ratio position.

With the fifth feature, when the piston outer element has reached the lower-compression ratio position, the operations of the piston inner and outer elements in unison with each other can be guaranteed.

According to a sixth aspect and feature of the present invention, in addition to any of the first to fifth features, a piston outer element restricting means is provided between the piston inner and outer elements for restricting the movement of the piston outer element relative to the piston inner element toward the combustion chamber, when the piston outer element has reached the higher-compression ratio position.

With the sixth feature, even when the piston outer element has reached the higher-compression ratio position, the operations of the piston inner and outer elements in unison with each other can be guaranteed.

According to a seventh aspect and feature of the present invention, in addition to any of the first to sixth features, the actuator comprises a hydraulically operating means operated by a hydraulic pressure from a hydraulic pressure source to operate the bulking member to the bulking position, and a return spring for biasing the bulking member toward the non-bulking position.

With the seventh feature, a single hydraulic pressure chamber suffices in the hydraulic operating means and hence, the construction of the hydraulically operating means can be simplified.

According to an eighth aspect and feature of the present invention, in addition to any of the first to seventh features, the piston outer element locking means comprises a locking member supported on the piston inner element to be moved between an operated position where the locking member is in engagement in a locking groove in an inner peripheral surface of the piston outer element and a retracted position the locking member is out of engagement in the locking groove, an operating spring for biasing the locking member toward the operated position, and a hydraulically returning means operated by the hydraulic pressure from the hydraulic pressure source to operate the locking member toward the retracted position. With the eighth feature, a single hydraulic pressure chamber suffices even in the piston outer element locking means and hence, the construction of the piston outer element locking means can be simplified.

According to a ninth aspect and feature of the present invention, in addition to any of the first to eighth features, the actuator comprises a hydraulically operating means operated by the hydraulic pressure from the hydraulic pressure source to operate the bulking member to the bulking position, and a returning spring for biasing the bulking member toward the non-bulking position, and the piston outer element locking means comprises a locking member supported on the piston inner element to be moved between an operated position where the locking member is in engagement in a locking groove in an inner peripheral surface of the piston outer element and a retracted position where the locking member is out of engagement in the locking groove, an operating spring for biasing the locking member toward the operated position, and a hydraulically returning means operated by the hydraulic pressure from the hydraulic pressure source to operate the locking member toward the retracted position, so that the hydraulic pressure in the hydraulic pressure source is supplied simultaneously to the hydraulically operating means and the hydraulically returning means.

With the ninth feature, the actuator and the piston outer element locking means can be operated rationally by the common hydraulic pressure, thereby providing the simplification of a hydraulic pressure circuit.

According to a tenth aspect and feature of the present invention, in addition to the first feature, the actuators are disposed in a plurality of sets in a circumferential direction of the bulking member.

With the tenth feature, the actuators are disposed in the plurality of sets in the circumferential direction of the bulking member and hence, operating forces of the actuators can be applied to the bulking member at a plurality of circumferential points to reliably turn the bulking member from the non-bulking position to the bulking position or from the bulking position to the non-bulking position. Moreover, it is possible to provide a reduction in size of the actuator and it is easy to dispose the actuators in narrow internal spaces in the piston.

According to an eleventh aspect and feature of the present invention, in addition to the tenth feature, the actuators are disposed in the plurality of sets at equal distances in the circumferential direction of the bulking member.

With the eleventh feature, during operation of the plurality of sets of actuators, the bulking member can be turned smoothly without application of an unbalanced load to the bulking member.

According to a twelfth aspect and feature of the present invention, in addition to the tenth or eleventh feature, the actuators are disposed in two sets on opposite sides of the piston pin.

With the twelfth feature, the two sets of actuators can be disposed at equal distances in the circumferential direction of the bulking member without being interfered by the piston pin, and the disposition of the actuators in narrow internal spaces in the piston can be achieved more simply.

According to a thirteenth aspect and feature of the present invention, in addition to the first feature, the actuator comprises an operating member and a returning member which are slidably disposed in the piston inner element on the same axis extending in a direction of turning of the bulking member and are opposed to each other on opposite sides of a pressure-receiving portion of the bulking member, so that the bulking member is turned alternately to the non-bulking position and the bulking position by alternately operating the operating member and the returning member.

With the thirteenth feature, the actuator comprises the operating member and the returning member which are slidably disposed in the piston inner element on the same axis extending in the direction of turning of the bulking member and are opposed to each other on the opposite sides of the pressure-receiving portion of the bulking member and hence, it is possible to provide a reduction in size of the actuator, and it is easy to dispose the actuator in a narrow internal space in the piston.

According to a fourteenth aspect and feature of the present invention, in addition to the thirteenth feature, the operating member and the returning member comprise an operating plunger and a returning plunger, respectively, which are slidably received in a common cylinder bore defined in the piston inner element and are opposed to each other on opposite sides of the pressure-receiving portion.

With the fourteenth feature, the cylinder bore is used commonly for the operating plunger and the returning plunger, leading to a simplification of the working for provision of the cylinder bore and a simplification of the construction.

According to a fifteenth aspect and feature of the present invention, in addition to the thirteenth or fourteenth feature, the operating member and the returning member are disposed on the same axis intersecting, at substantially right angles, a radial line of the bulking member extending through the center of the pressure-receiving portion.

With the fifteenth feature, the operating force of the operating member and the returning force of the returning member can be transmitted efficiently to the bulking member through the pressure-receiving portion and hence, it is possible to provide reductions in capacity and size of the actuator.

According to a sixteenth aspect and feature of the present invention, in addition to any of the thirteenth to fifteenth features, the actuators are disposed in a plurality of sets at equal distances in a circumferential direction of the bulking member.

With the sixteenth feature, the bulking member can be turned smoothly by the operation of the plurality of sets of actuators without application of an unbalanced load to the bulking member.

The above-described piston outer element restricting means corresponds to a stop ring 18, 118 in embodiments of the present invention which will be described hereinafter. The above-described hydraulically operating means corresponds to an operating plunger 23, 123 and a first hydraulic pressure chamber 25, 125 which will be described hereinafter, and the above-described hydraulically returning means corresponds to a second hydraulic pressure chamber 37, 137 and a piston 38, 138 which will be described hereinafter.

Further, according to a seventeenth aspect and feature of the present invention, in addition to any of the thirteenth to sixteenth features, the actuators are disposed in two sets on opposite sides of the piston pin.

With the seventeenth feature, the two sets of actuators can be disposed at equal distances in the circumferential direction of the bulking member without being interfered by the piston pin, and the disposition of the actuators in narrow internal spaces in the piston can be achieved easily.

The above and other objects, features and advantages of the invention will become apparent from the following detailed description of the preferred embodiments taken in conjunction with the accompanying drawings.

BEST MODE FOR CARRYING OUT THE INVENTION

A first embodiment of the present invention shown in FIGS. 1 to 10 will first be described.

Figure 1:
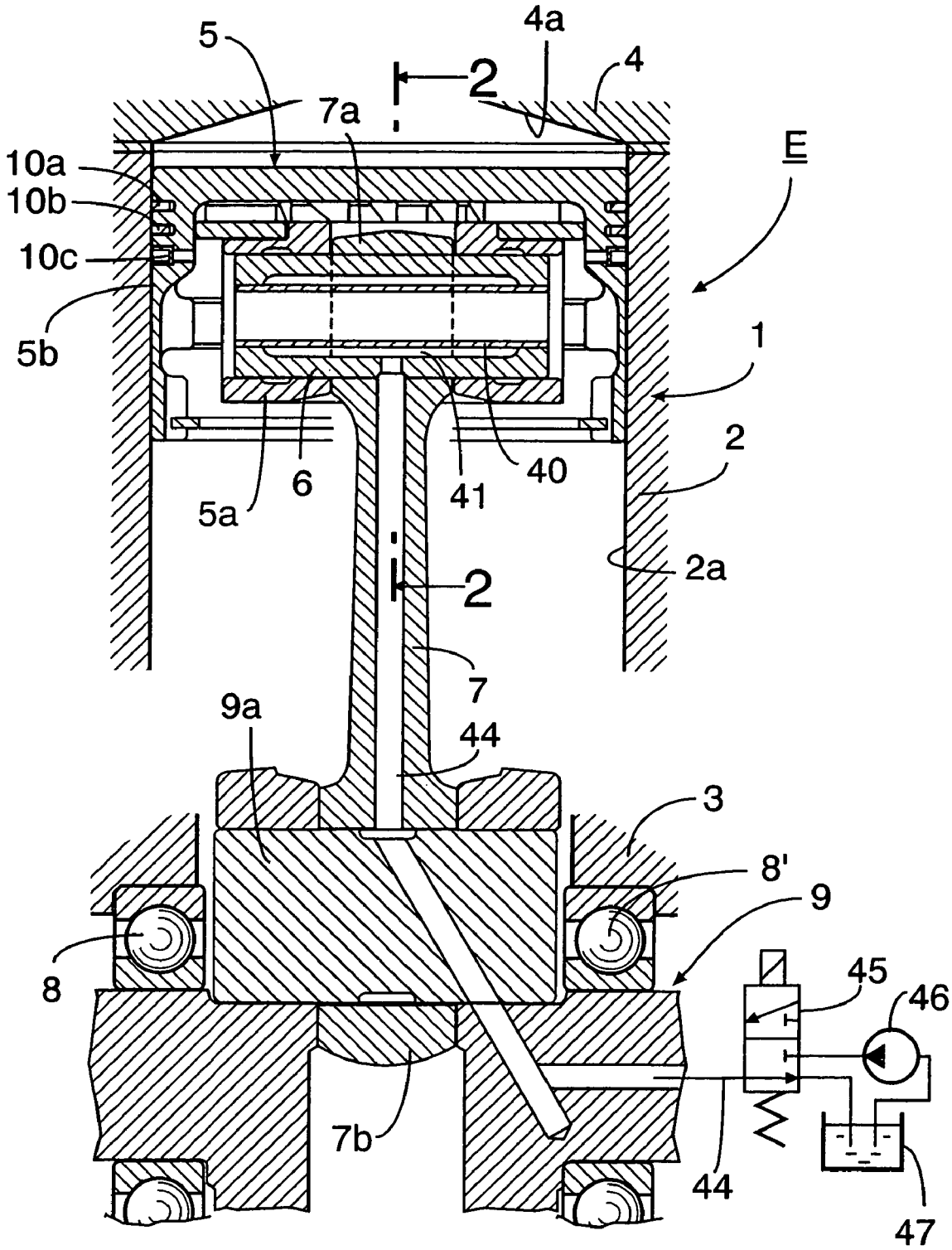
FIG. 1 is a vertical sectional front view of essential portions of an internal combustion engine provided with a compression ratio changing device according to a first embodiment of the present invention.
Figure 2:
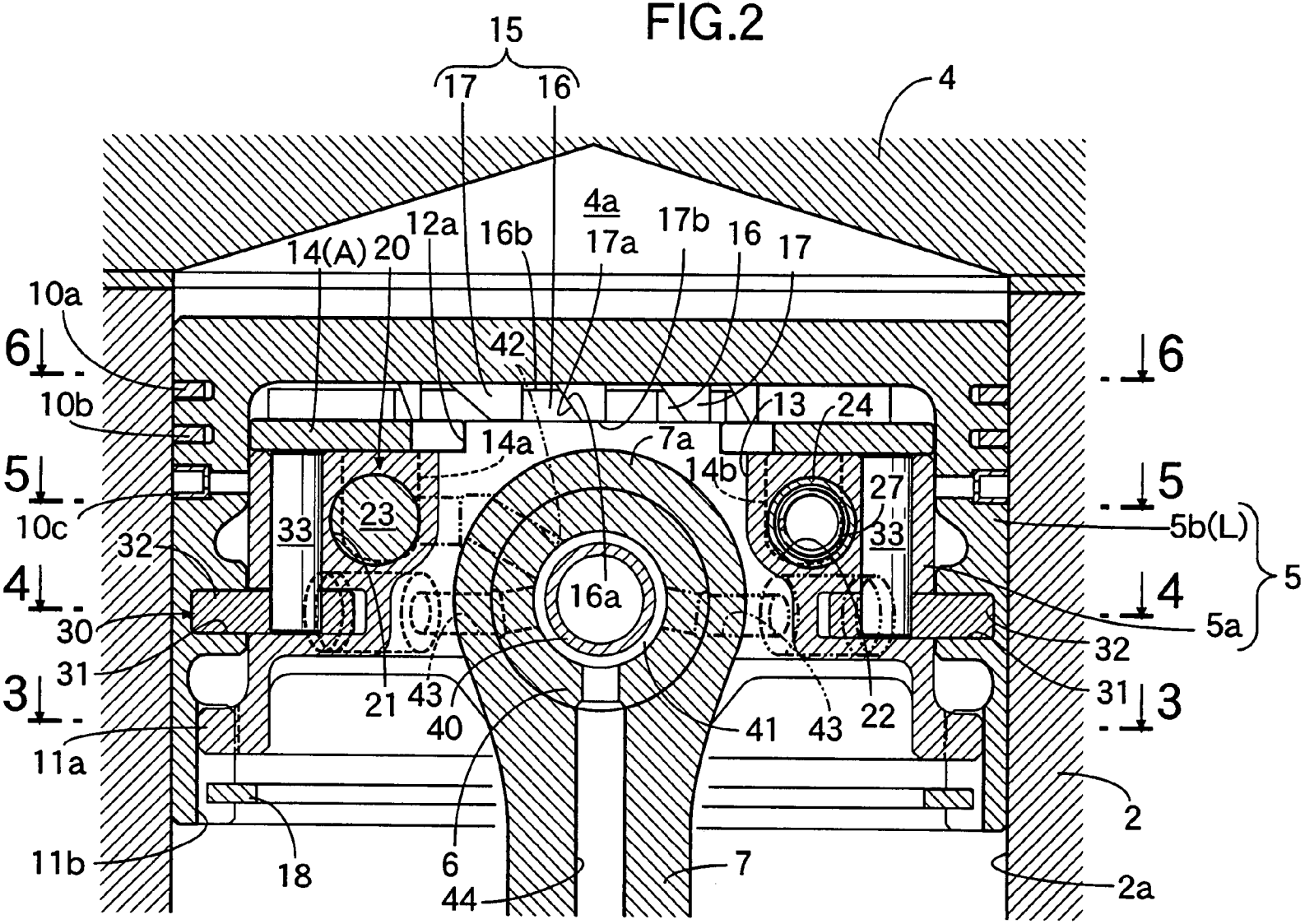
FIG. 2 is an enlarged sectional view taken along a line 2—2 in FIG. 1 and showing a lower-compression ratio state.

Referring to FIGS. 1 and 2, an engine body 1 of an internal combustion engine E comprises a cylinder block 2 having a cylinder bore 2*a*, a crankcase 3 coupled to a lower end of the cylinder block 2, and a cylinder head 4 coupled to an upper end of the cylinder block 2 and having a combustion chamber 4*a* leading to the cylinder bore 2*a*. A connecting rod 7 is connected at its smaller end 7*a* through a piston pin 6 to a piston 5 slidably received in the cylinder bore 2*a* and at its larger end 7*b* to a crank pin 9*a* of a crankshaft 9 rotatably carried on a crankcase 3 with a pair of left and right bearings 8 and 8' interposed therebetween.

The piston 5 comprises a piston inner element 5*a* connected to the smaller end 7*a* of the connecting rod 7 through the piston pin 6, and a piston outer element 5*b* slidably fitted over an outer peripheral surface of the piston inner element 5*a* and to an inner peripheral surface of the cylinder bore 2*a* with its top face exposed to the combustion chamber 4*a*. A plurality of piston rings 10*a* to 10*c* are mounted around an outer periphery of the piston outer element 5*b* and slidably put into close contact with the inner peripheral surface of the cylinder bore 2*a*.

Figure 3:
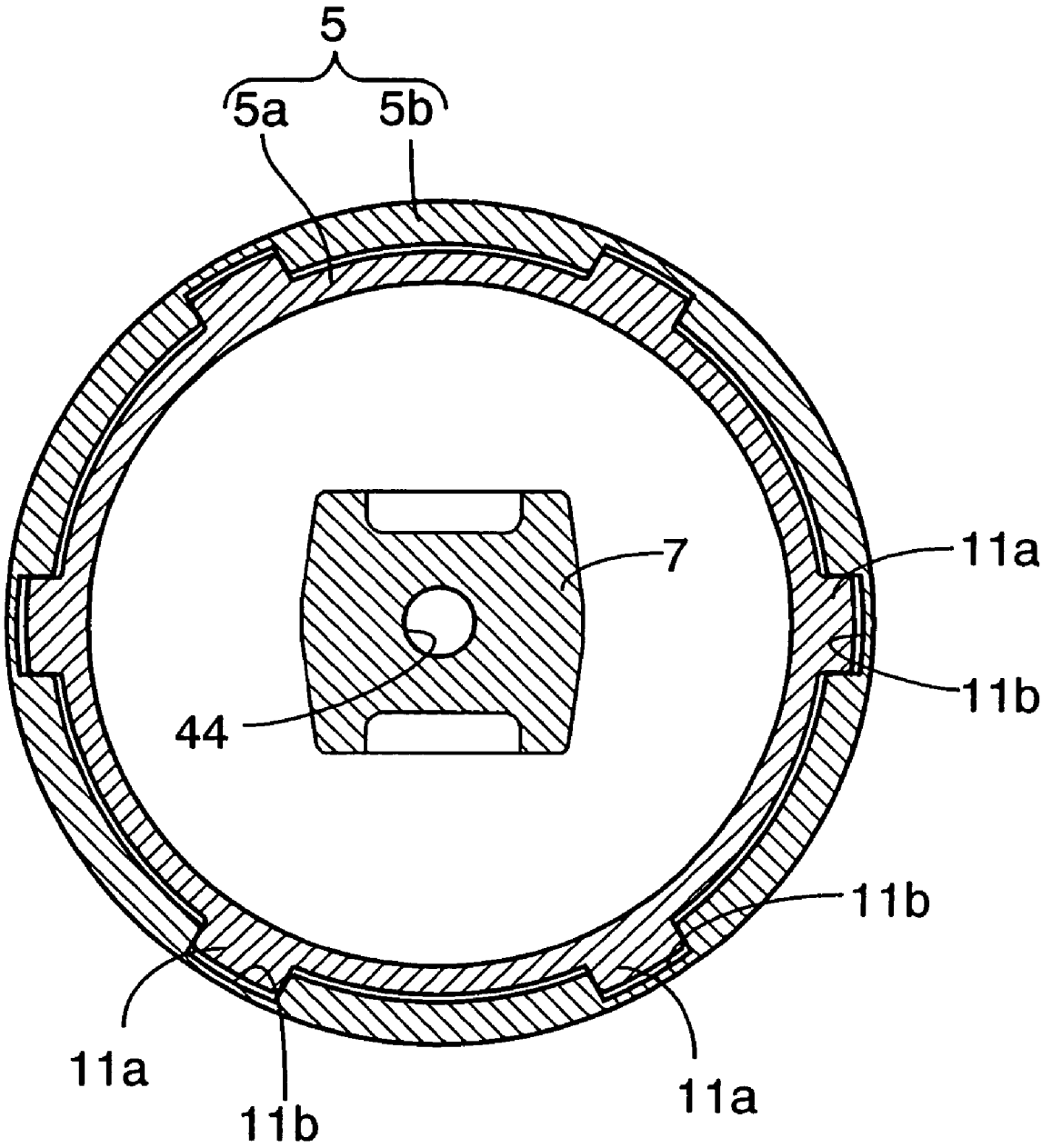
FIG. 3 is a sectional view taken along a line 3—3 in FIG. 2.

As shown in FIGS. 2 and 3, a plurality of spline teeth 11*a* and a plurality of spline grooves 11*b* are formed on slidably fitted surfaces of the piston inner and outer elements 5*a* and 5*b* respectively to extend in an axial direction of the piston 5 and engaged with each other, so that the piston inner and outer elements 5*a* and 5*b* cannot be rotated about their axes relative to each other.

Figure 6:
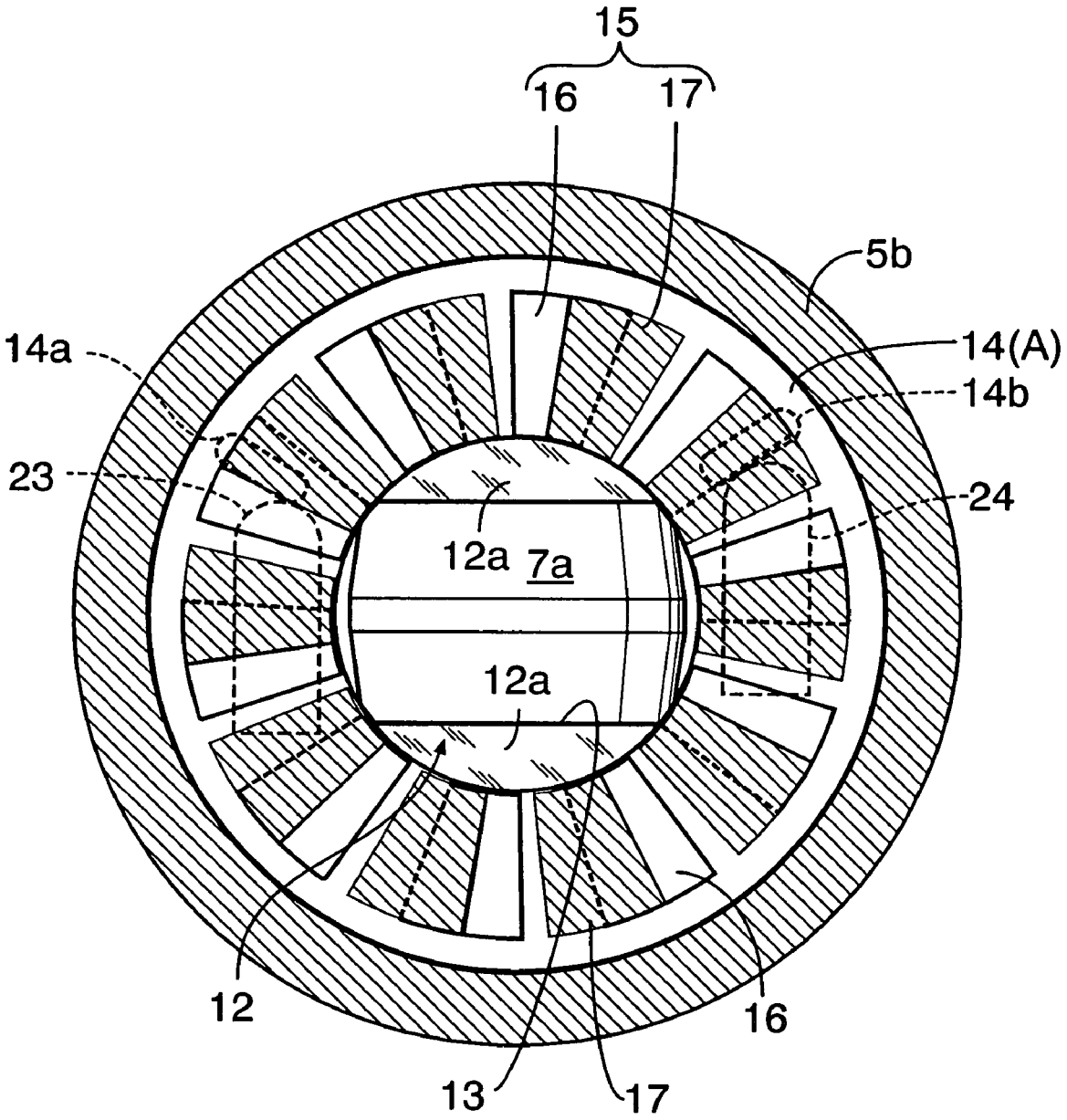
FIG. 6 is a sectional view taken along a line 6—6 in FIG. 2.

Referring to FIGS. 2 and 6, an annular bulking member 14 is placed on an upper surface of the piston inner element 5*a* and turnably fitted over a pivot 12 integrally and projectingly provided on such upper surface. The pivot 12 is divided into a plurality of (two in FIGS. 2 and 6) blocks 12*a*, 12*a* to receive the smaller end 7*a* of the connecting rod 7.

The bulking member 14 is capable of being turned between first and bulking positions A and B established about its axis, and a cam mechanism 15 is provided between the bulking member 14 and the piston outer element 5*b* and moves the piston outer element 5*b* alternately to a lower-compression ratio position L (see FIGS. 2 and 10A) close to the piston inner element 5*a* and a higher-compression ratio position H (see FIGS. 7 and 10C) close to the combustion chamber 4*a* in response to the reciprocal turning movement of the bulking member 14.

Figure 10A:
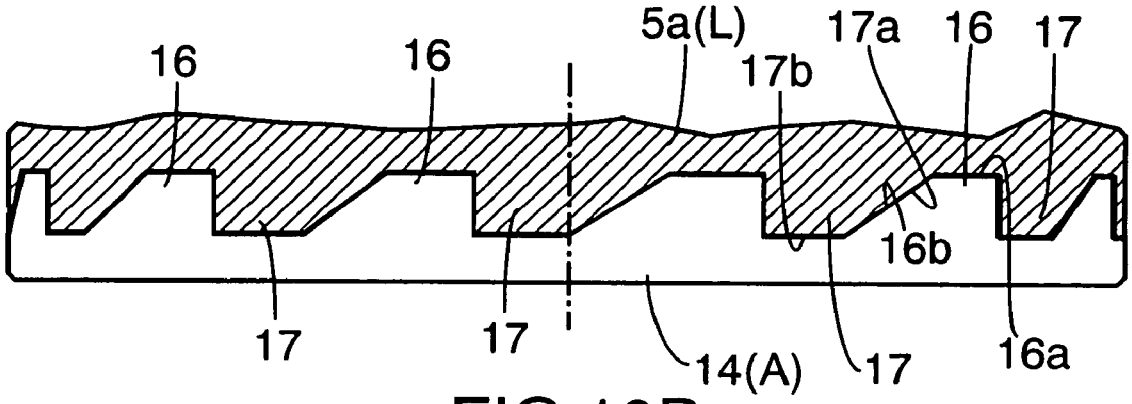
FIGS. 10A to 10C are diagrams for explaining the operation of a bulking member.
Figure 10B:
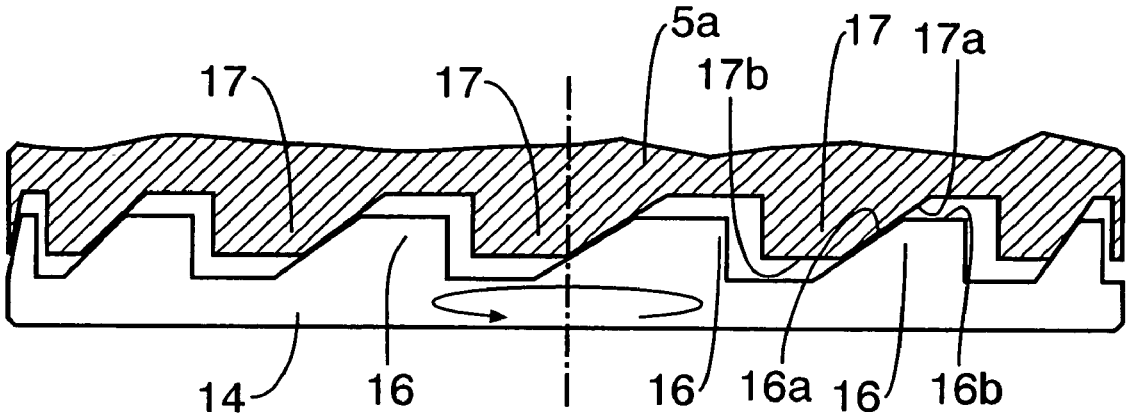
Figure 10C:
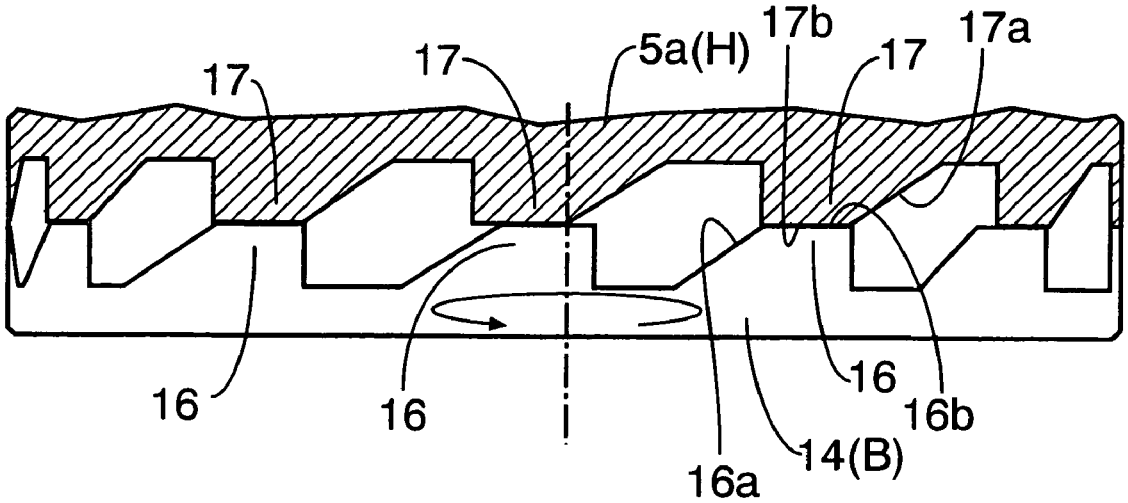

As best shown in FIGS. 10A to 10C, the cam mechanism 15 comprises a plurality of convex first cams 16 formed on an upper surface of the bulking member 14, and a plurality of convex second cams 17 formed on a lower surface of a top wall of the piston outer element 5*b*. The first and second cams 16 and 17 are formed so that they are arranged circumferentially alternately with each other to permit the movement of the piston outer element 5*b* to the lower-compression ratio position L, when the bulking member 14 is in the non-bulking position A. Each of the first cams 16 and each of the second cams 17 are provided respectively with slants 16*a* and 17*a* which are slipped on each other axially away from each other, when the bulking member 14 is turned from the non-bulking position A to the bulking position B, and flat top faces 16*b* and 17*b* which abut against each other to retain the piston outer element 5*b* at the higher-compression ratio position H, when the bulking member 14 has reached the bulking position B. A stop ring 18 capable of abutting against a lower end face of the piston inner element 5*a* is locked to an inner peripheral surface of a lower end of the piston outer element 5*b*, and serves as a restricting means for inhibiting the further movement of the piston outer element 5*b* beyond the higher-compression ratio position H toward the combustion chamber 4*a*, when the piston outer element 5*b* has reached the higher-compression ratio position H.

An actuator 20 for turning the bulking member 14 to the first and bulking positions A and B is mounted between the piston inner element 5*a* and the bulking member 14. The actuator 20 will be described below with reference to FIGS. 2, 5 and 6.

First and second bottomed cylinder bores 22 are provided in the piston inner element 5*a* on opposite sides of the piston pin 6 to extend in parallel to the piston pin 6, and first and second plungers 23 and 24 are slidably received in the cylinder bores 21 and 22. Tip ends of the operating and returning plungers 23 and 24 protrude in the same direction from the first and second cylinder bores 21 and 22, and first and second pressure-receiving pieces 14*a* and 14*b* are projectingly provided on a lower surface of the bulking member 14 and disposed to abut against such tip ends.

A first hydraulic pressure chamber 25 is defined in the first cylinder bore 21 and faced by an inner end of the operating plunger 23, so that when a hydraulic pressure is supplied to the first hydraulic pressure chamber 25, the operating plunger 23 receives the hydraulic pressure to turn the bulking member 14 through the first pressure-receiving piece 14*a* to the bulking position B. A spring chamber 25 is defined in the second cylinder bore 22 and faced by an inner end of the returning plunger 24, and a return spring 27 is accommodated in the spring chamber 25, so that the returning plunger 24 biases the bulking member 14 to the non-bulking position A through the second pressure-receiving piece 14*b* by a force of the return spring 27. The non-bulking position A of the bulking member 14 is defined by the abutment of the first pressure-receiving piece 14*a* against the tip end of the operating plunger 23 abutting against a bottom surface of the first cylinder bore 21 (see FIG. 5), and the bulking position B of the bulking member 14 is defined by the abutment of the second pressure-receiving piece 14*b* against the tip end of the returning plunger 24 abutting against a bottom surface of the second cylinder bore 22 (see FIG. 9).

The bulking member 14 and the actuator 20 permit the movement of the piston outer element 5*b*between the lower-compression ratio position L and the higher-compression ratio position H by natural external forces applied to the piston inner and outer elements 5*a* and 5*b* to move the elements 5*a* and 5*b* axially away from and toward each other, such as an inertia force of the piston outer element 5*b*, a friction resistance received from the inner surface of the cylinder bore 2*a* by the piston outer element 5*b*, an intake negative pressure applied to the piston outer element 5*b* and the like.

A piston outer element locking means is provided between the piston inner element 5*a* and the piston outer element 5*b* to lock the piston outer element 5*b* to the piston inner element 5*a*, when the piston outer element 5*b* has reached the lower-compression ratio position L. The piston outer locking means 30 will be described with reference to FIGS. 2 and 4.

A plurality of locking grooves 31 are defined at equal distances in the inner peripheral surface of the piston inner element 5*a* to extend circumferentially, and a plurality of locking levers 32 are swingably mounted on the piston inner element 5*a* through pivots 33, so that they are brought into and out of engagement in the locking grooves 31 when the piston outer element 5*b* has reached the lower-compression ratio position L. Namely, the locking levers 32 are capable of being swung between an operated position (see FIG. 4) where they are in engagement in the locking grooves 31 and a retracted position D (see FIG. 8) where they are out of engagement in the locking grooves 31.

Each of the locking levers 32 comprises a long arm portion 32*a* which is brought into and out of engagement in the locking groove 31, and a short arm portion 32*b* extending in a direction opposite from the long arm portion 32*a* with the pivot 33 interposed therebetween. An operating spring 34 for biasing the long arm portion 32*a* in a direction to engage in the locking groove 31 is mounted under compression between the long arm portion 32*a* and the piston inner element 5*a*. In this case, a positioning projection 35 is formed on the long arm portion 32*a* and fitted to an inner periphery of the operating spring 34 to retain the operating spring 34 in place. On the other hand, a plurality of cylinder bores 36 are defined in the piston inner element 5*a* in correspondence to the short arm portions 32*b*, and a plurality of pistons 38 are slidably received in the cylinder bores 36 and disposed with their tip ends abutting against tip ends of the short arm portions 32*b*. A second hydraulic pressure chamber 37 is defined in each of the cylinder bores 36 and faced by an inner end of the corresponding piston 38, so that when a hydraulic pressure is supplied to the second hydraulic pressure chamber 37, the piston 38 receives such hydraulic pressure to move the locking lever 32 away from the locking groove 31 against the force of the operating spring 34.

Figure 4:
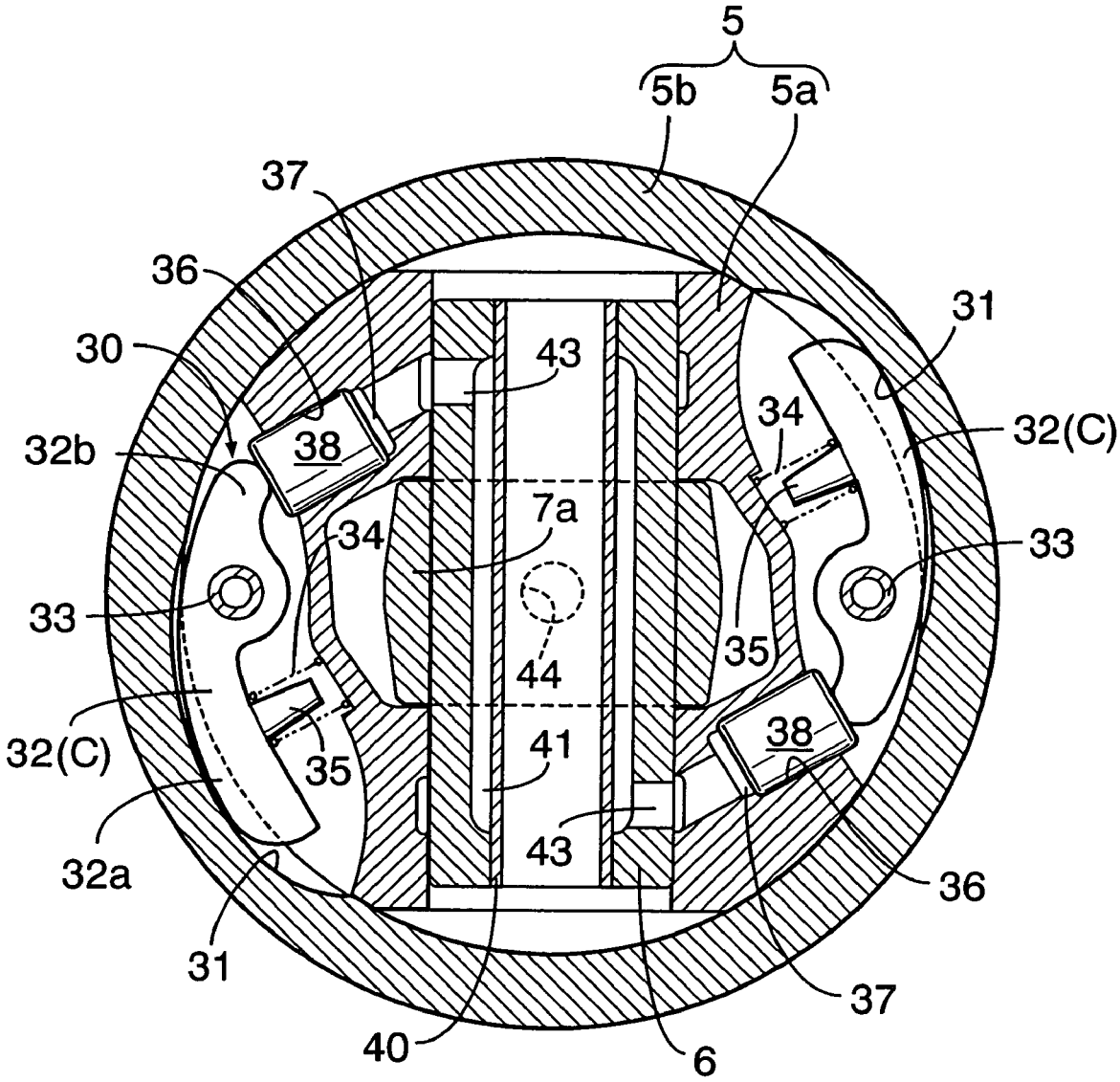
FIG. 4 is a sectional view taken along a line 4—4 in FIG. 2.
Figure 5:
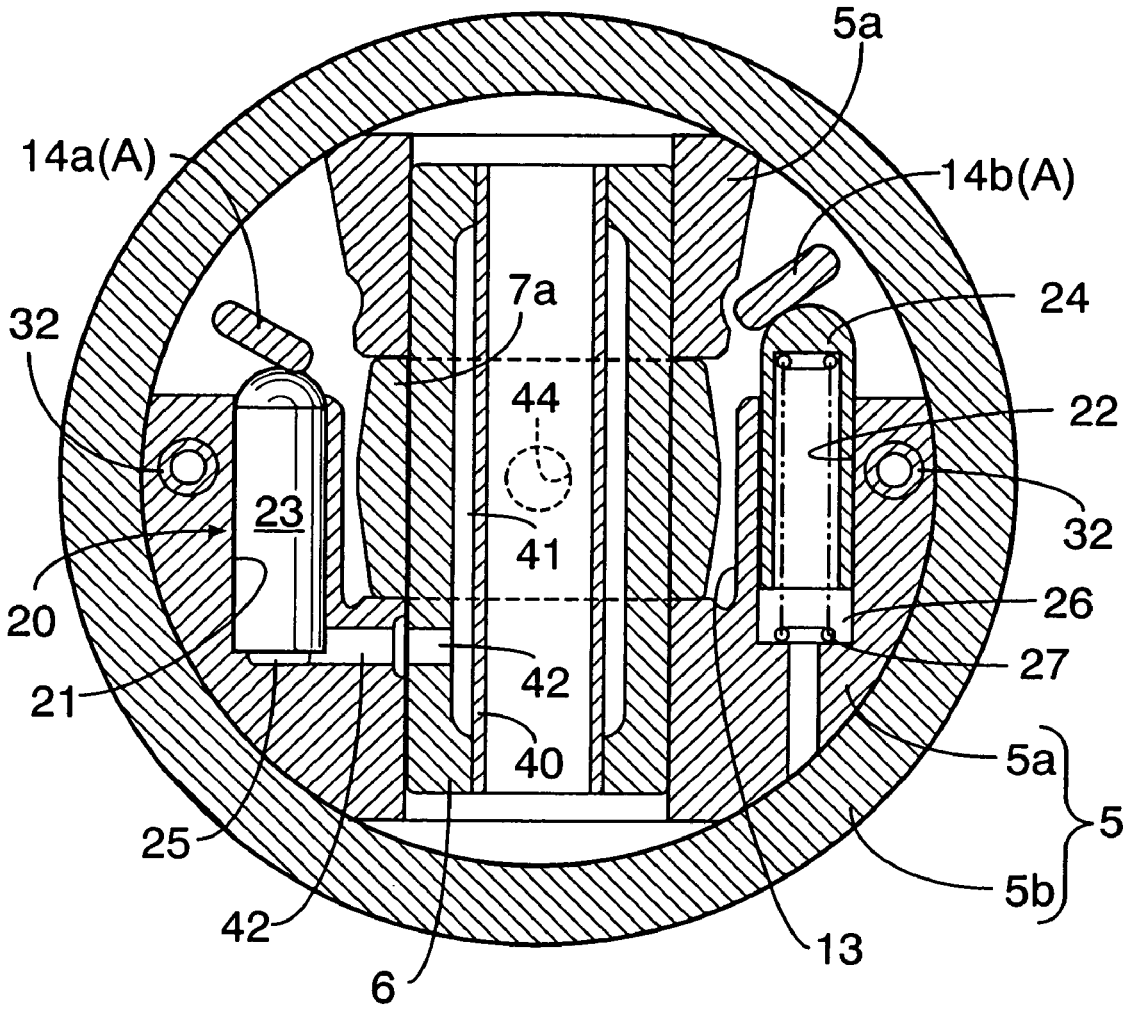
FIG. 5 is a sectional view taken along a line 5—5 in FIG. 2.

As shown in FIGS. 4 and 5, a cylindrical oil chamber 41 is defined between the piston pin 6 and a sleeve 40 press-fitted into a hole in the piston pin 6, and first and second distributing oil passage 42 and 43 are provided to extend within the piston pin 6 and the piston inner element 5*a* and to connect the oil chamber 41 to the first and second hydraulic pressure chambers 25 and 37. The oil chamber 41 is connected to an oil passage 44 provided to extend within the piston pin 6, the connecting rod 7 and the crankshaft 9, as shown in FIG. 1, and the oil passage 44 is connected switchably to an oil pump 46 as a hydraulic pressure source and an oil reservoir 47 through a solenoid switchover valve 45.

The operation of this embodiment will be described below.

To provide a lower-compression ratio state to avoid the knocking, for example, in the rapidly accelerating operation of the internal combustion engine E, the solenoid switchover valve 45 is brought into a non-energized state as shown in FIG. 1 to put the oil passage 44 into communication with the oil reservoir 47. This causes both of the first hydraulic pressure chamber 25 and the second hydraulic pressure chamber 37 to be opened to the oil reservoir 47 through the oil chamber 41 and the oil passage 44. Therefore, in the actuator 20, the returning plunger 24 pushes the second pressure-receiving piece 14*b* under the action of the biasing force of the return spring 27 to turn the bulking member 14 to the non-bulking position A, as shown in FIG. 5. As a result, the first cam 16 and the second cam 17 of the cam mechanism 15 are disposed in positions in which their tops are misaligned from each other, as shown in FIG. 10A and hence, when the piston outer element 5*b* has been pushed relative to the piston inner element 5*a* by a pressure in the combustion chamber 4*a* in an expansion stroke or a compression stroke of the engine, when the piston outer element 5*b* has been pushed relative to the piston inner element 5*a* by a friction resistance produced between the piston rings 10*a* to 10*c* and the inner surface of the cylinder bore 2*a* in an upstroke of the piston 5, or when the piston outer element 5*b* has been pushed relative to the piston inner element 5*a* by its inertia force with the deceleration of the piston inner element 5*a* in the latter half of a downstroke of the piston 5, the piston outer element 5*b* can be lowered relative to the piston inner element 5*a* to reach the lower-compression ratio position L, while allowing the first cam 16 and the second cam 17 to be meshed with each other. At that time, in the piston outer element locking means 30, the locking lever 32 pivotally supported on the piston inner element 5*a* and the locking groove 31 in the piston outer element 5*b* are opposed to each other and hence, the locking lever 32 is swung by the biasing force of the operating spring 34, so that the long arm portion 32*a* is brought into engagement in the locking groove 31, and the piston outer element 5*b* is retained in the lower-compression ratio position L by the engagement of the long arm portion 32*a* and the locking groove 31. Thus, plays in the cam mechanism 15 are eliminated, and the piston inner and outer elements 5*a* and 5*b* can be lifted and lowered together with each other within the cylinder bore 2*a*, while decreasing the compression ratio.

Figure 7:
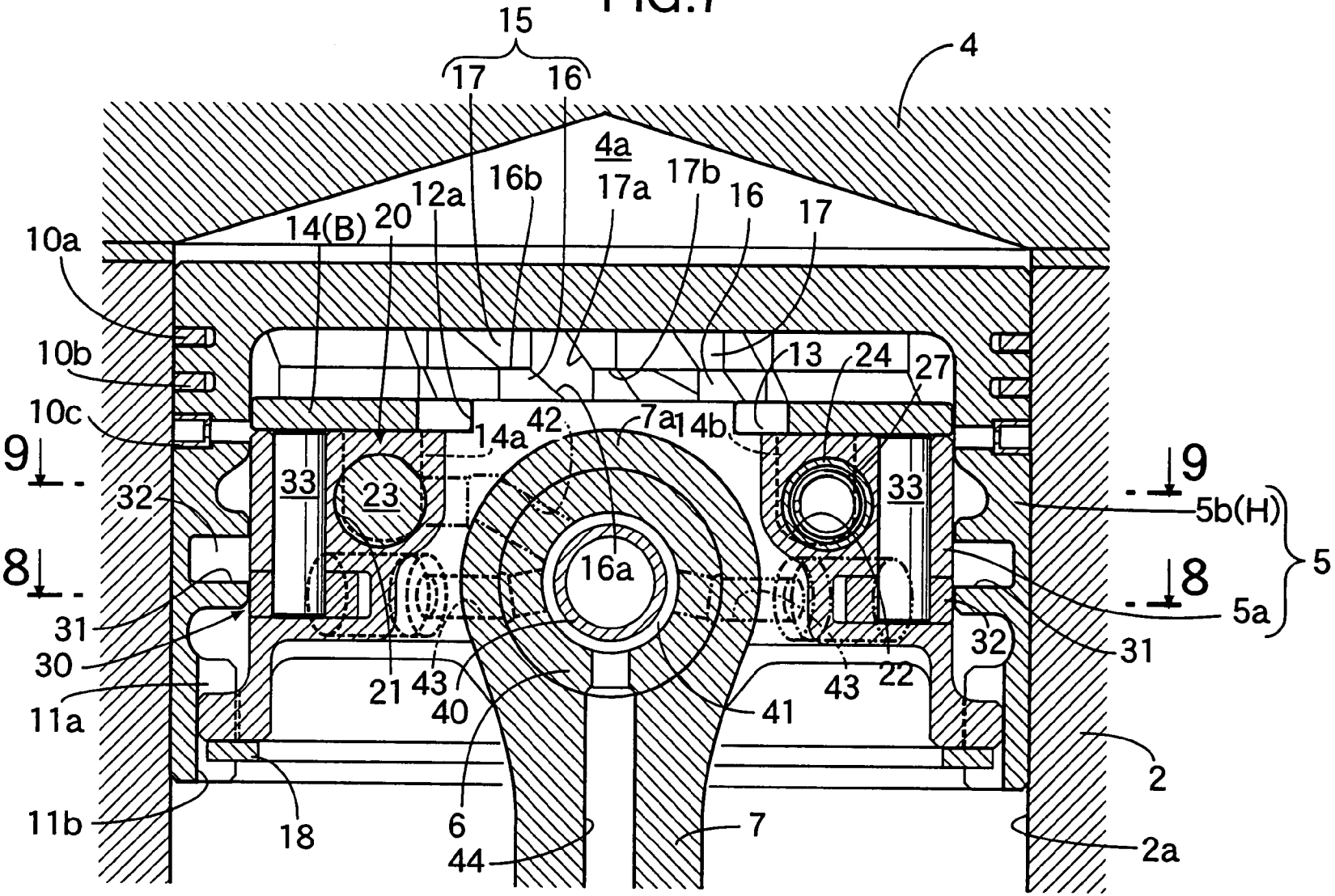
FIG. 7 is a view similar to FIG. 2, but showing a higher-compression ratio state.
Figure 8:
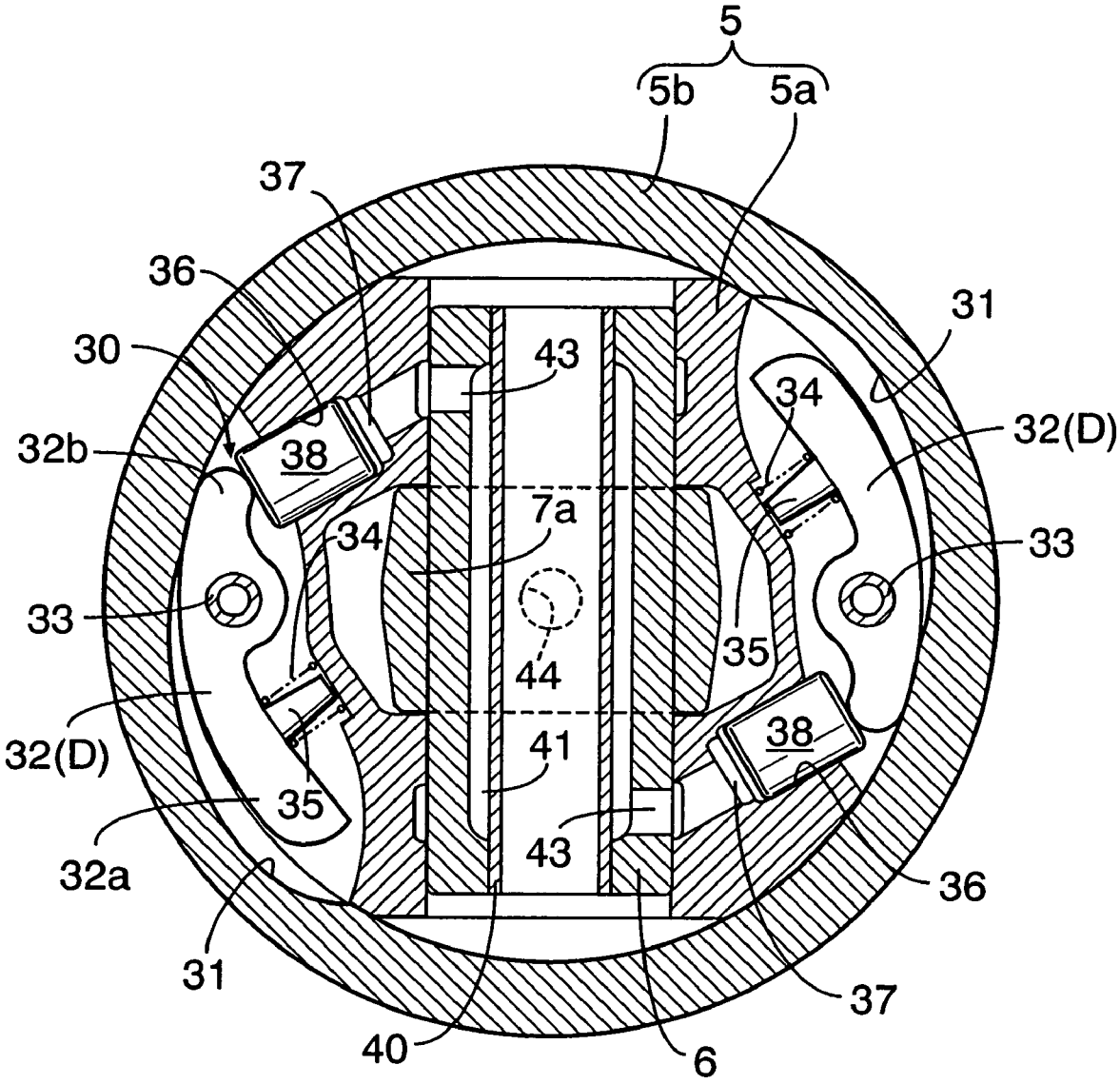
FIG. 8 is a sectional view taken along a line 8—8 in FIG. 7.
Figure 9:
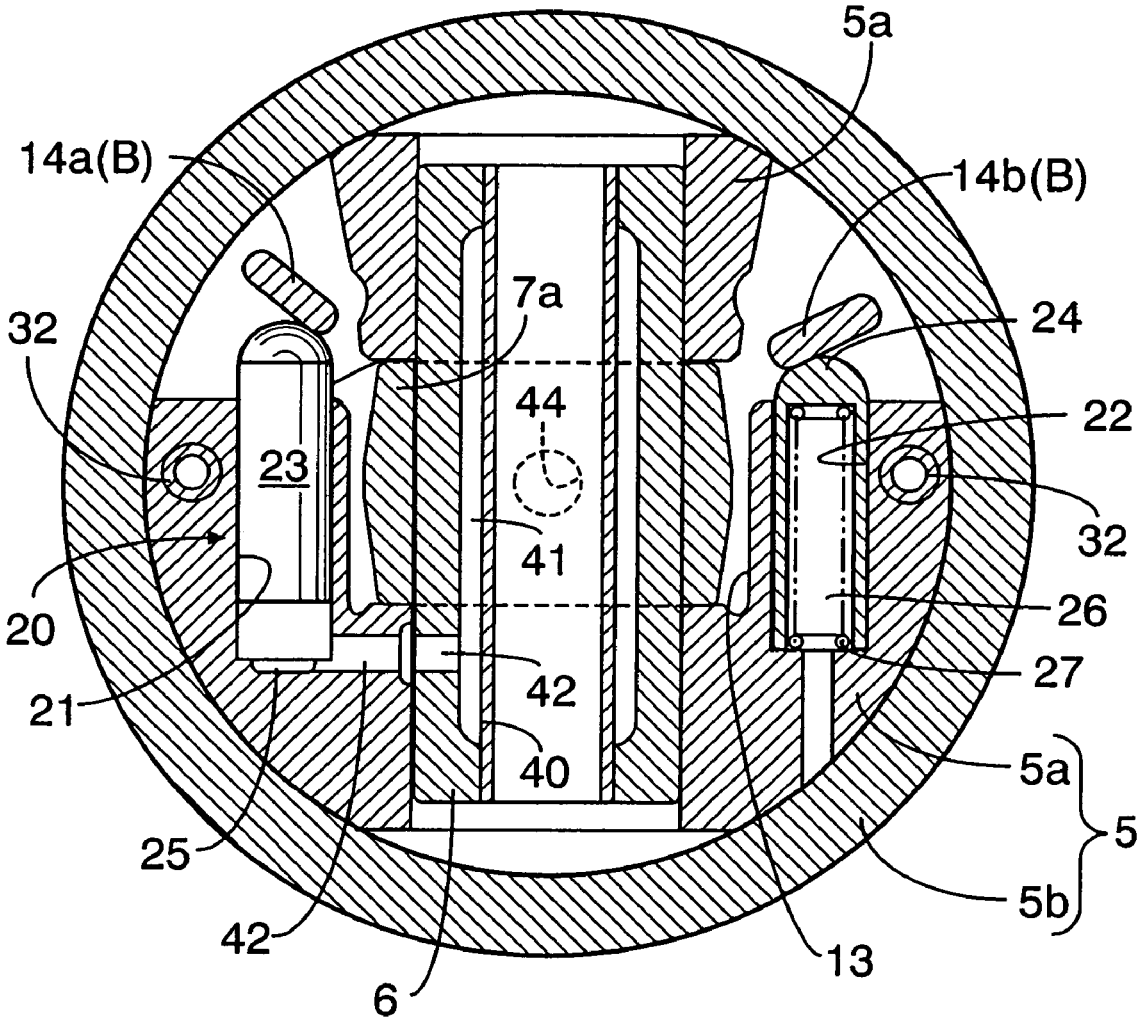
FIG. 9 is a sectional view taken along a line 9—9 in FIG. 7.

To provide a higher-compression ratio state in order to provide an increase in output, for example, during the high-speed operation of the internal combustion engine E, electric current is supplied to the solenoid switchover valve 45 to connect the oil passage 44 to the oil pump 46. This causes the hydraulic pressure discharged from the oil pump 46 to be supplied through the oil passage 44 and the oil chamber 41 to the first hydraulic pressure chamber 25 and the second hydraulic pressure chamber 37. Therefore, first, in the piston outer element locking means 30, the piston 38 receives the hydraulic pressure in the second hydraulic chamber 37 to swing the locking lever 32 to the retracted position D against the biasing force of the operating spring 34, thereby disengaging the long arm portion 32*a* from the locking groove 31 in the piston outer element 5*b*, as shown in FIG. 8. When the locking lever 32 has been disengaged from the locking groove 31, the movement of the piston outer element 5*b* to the higher-compression ratio position H is permitted. Therefore, in the actuator 20, the operating plunger 23 receives the hydraulic pressure in the first hydraulic pressure chamber 25 to push the first pressure-receiving piece 14*a*, thereby turning the bulking member 14 from the non-bulking position A to the bulking position B, as shown in FIG. 9. In the cam mechanism 15, the first cam 16 and the second cam 17 are axially moved away from each other with the turning of the bulking member 14, while their slants 16*a* and 17*a* are slipped on each other (see FIG. 10B). When the bulking member 14 has reached the bulking position, as is shown in FIG. 7, the cams 16 and 17 reach states in which their flat top faces 16*b* and 17*b* are in abutment against each other (see FIG. 10C), thereby pushing the piston outer element 5*b* up to the higher-compression ratio position H. At this time, the stop ring 18 on the piston outer element 5*b* is put into abutment against the lower end face of the piston inner element 5*a* to inhibit the further movement of the piston outer element 5*b* toward the combustion chamber 4*a* and hence, the higher-compression ratio position H of the piston outer element 5*b* is maintained by the abutment of the top faces 16*b* and 17*b* of the cams 16 and 17 against each other and the abutment of the stop ring 18 against the lower end face of the piston inner element 5*a*. Thus, plays in the cam mechanism 15 are eliminated, and the piston inner and outer elements 5*a* and 5*b* can be lifted and lowered together with each other within the cylinder bore 2*a*, while increasing the compression ratio.

When the piston outer element 5*b* is moved between the lower-compression ratio position L and the higher-compression ratio position H, the rotation of the piston outer element 5*b* relative to the piston inner element 5*a* is restrained by the spline teeth 11*a* and the spline grooves 11*b* formed in fitted surfaces of the piston inner element 5*a* and the piston outer element 5*b* and slidably engaged with each other. The shape of the top face of the piston outer element 5*b* facing to the combustion chamber 4*a* can be formed in correspondence to the shape of the combustion chamber 4*a* to effectively increase the compression ratio in the higher-compression ratio position H of the piston outer element 5*b*. Moreover, in the higher-compression ratio position H of the piston outer element 5*b*, in the expansion stroke of the engine, a large thrust force received from the combustion chamber 4*a* by the piston outer element 5*b* is applied vertically to the flat top faces 16*b* and 17*b* of the first cam 16 and the second cam 17, which abut against each other. Therefore, the bulking member 14 cannot be turned by such thrust force and hence, the hydraulic pressure supplied to the first hydraulic pressure chamber 25 is not required to be as high as it opposes the thrust force, and even if bubbles exist in a small amount in the first hydraulic pressure chamber 25, the piston outer element 5*b* can be retained stably in the higher-compression ratio position H, thereby causing no hindrance.

It should be noted here that when the locking lever 32 has been disengaged from the locking groove 31, natural external forces which will be described below assist in movement of the piston outer element 5*b* to the high-compression ratio position H. Namely, when the piston outer element 5*b* has been pulled toward the combustion chamber 4*a* by an intake negative pressure in the intake stroke of the engine, when the piston outer element 5*b* has been left behind from the piston inner element 5*a* by a friction resistance produced between the piston rings 10*a* to 10*c* and the inner surface of the cylinder bore 2*a* in the downstroke of the piston 5, or when the piston outer element 5*b* is about to be floated from the piston inner element 5*a* by its inertia force with the deceleration of the piston inner element 5*a* in the latter half of the upstroke of the piston 5, the piston outer element 5*b* can be lifted from the piston inner element 5*a* to easily reach the higher-compression ratio position H. As a result, the movement of the piston outer element 5*b* to the higher-compression ratio position H can be conducted quickly in cooperation with the operation of the actuator 20. This can contribute to an enhancement in responsiveness.

Among the natural external forces contributing to the switchover of one of the lower-compression ratio position L and the higher-compression ratio position H of the piston outer element 5*b* to the other, the friction resistance between the piston rings 10*a* to 10*c* and the inner surface of the cylinder bore 2*a* and the inertia force of the piston outer element 5*b* are particularly effective. The variation in friction resistance is relatively small, as compared with the variation in rotational speed of the engine, but the inertia force of the piston outer element 5*b* is increased in a secondary curve in accordance with an increase in rotational speed of the engine. Therefore, for the switchover of the position of the piston outer element 5*b*, the friction resistance is dominant in a lower rotational speed range of the engine, and the inertia force of the piston outer element 5*b* is dominant in a higher rotational speed range of the engine.

The actuator 20 is comprised of the operating plunger 23 capable of being operated by the hydraulic pressure in the first hydraulic pressure chamber 25 to turn the bulking member 14 from the non-bulking position A to the bulking position B, and the returning plunger 24 capable of being operated by the biasing force of the return spring 27 to return the bulking member 14 from the bulking position B to the non-bulking position A in the release of the hydraulic pressure in the first hydraulic pressure chamber 25. Therefore, the single hydraulic pressure chamber 25 suffices and hence, the construction can be simplified.

The piston outer element locking means 30 is comprised of the locking lever 32 which is moved between the operated position C where it is pivotally supported on the piston inner element 5*a* and engaged in the locking groove 31 in the piston outer element 5*b*, and the retracted position D where it is disengaged from the locking groove 31, the operating spring 34 for biasing the locking lever 32 toward the operated position C, and the piston 38 operated by the hydraulic pressure in the second hydraulic pressure chamber 37 to operate the locking lever 32 to the retracted position D. Therefore, even in the locking means 30, the single hydraulic pressure chamber 37 suffices and hence, the construction can be simplified.

Further, the oil pump 46 and the oil reservoir 47 are switchably connected to the first and second hydraulic pressure chambers 25 and 37 through the common solenoid switchover valve 45 and hence, the actuator 20 and the piston outer element locking means 30 can be operated rationally by the common hydraulic pressure, whereby the hydraulic pressure circuit can be simplified, and the compression ratio changing device can be provided at a low cost.

A second embodiment of the present invention shown in FIGS. 11 to 21 will be described below.

Figure 11:
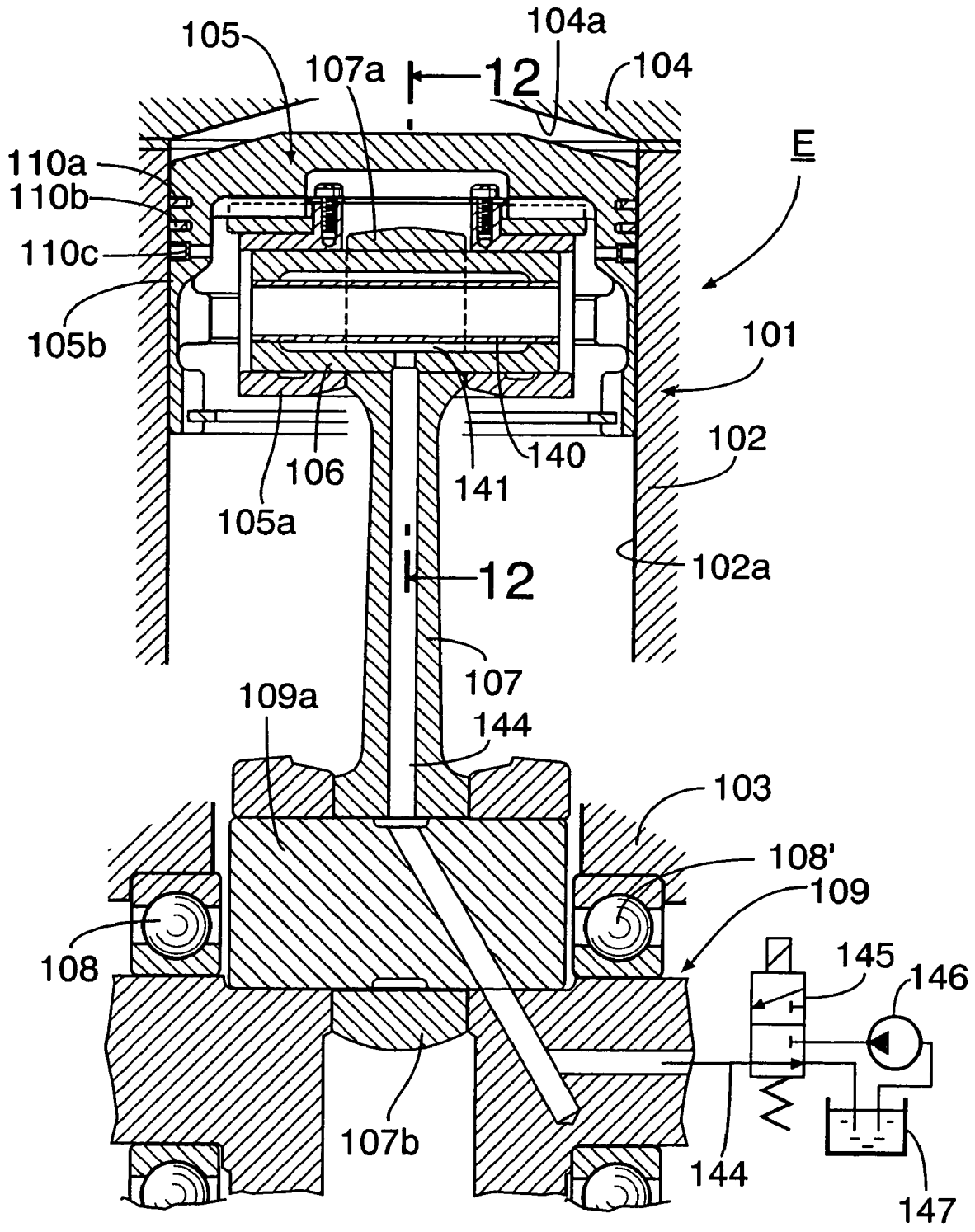
FIG. 11 is a vertical sectional front view of essential portions of an internal combustion engine provided with a compression ratio changing device according to a second embodiment of the present invention.
Figure 12:
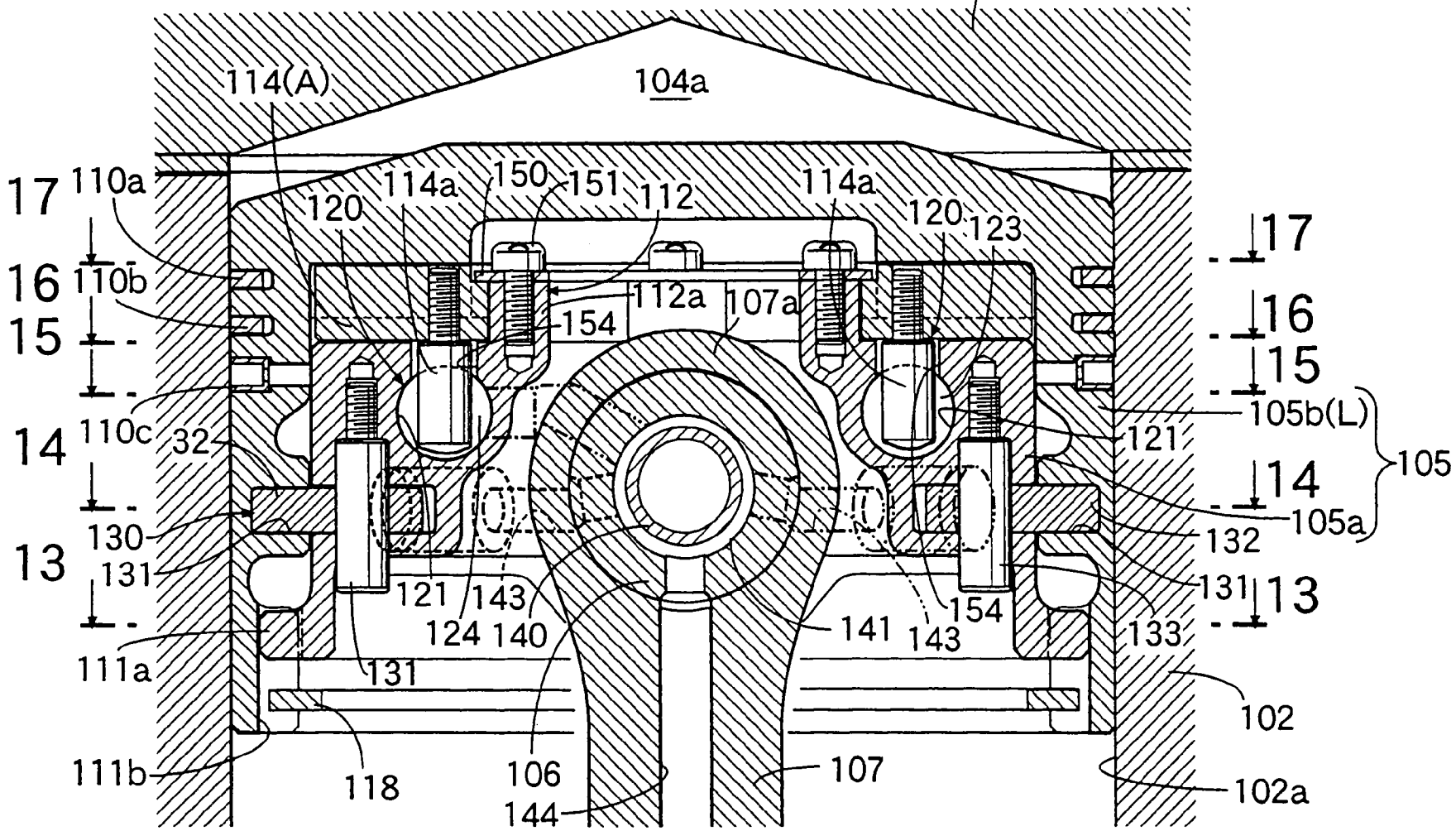
FIG. 12 is an enlarged sectional view taken along a line 12—12 in FIG. 11 and showing a lower-compression ratio state.

Referring to FIGS. 11 and 12, a piston 105 comprises a piston inner element 105*a* connected to a smaller end 107*a* of a connecting rod 107 through a piston pin 106, and a piston outer element 105*b* slidably fitted over an outer peripheral surface of the piston inner element 105*a* and to an inner peripheral surface of a cylinder bore 102*a* with its top face exposed to a combustion chamber 104*a*. A plurality of piston rings 110*a* to 110*c* are mounted around an outer periphery of the piston outer element 105*b* and slidably put into close contact with the inner peripheral surface of the cylinder bore 102*a*.

Figure 13:
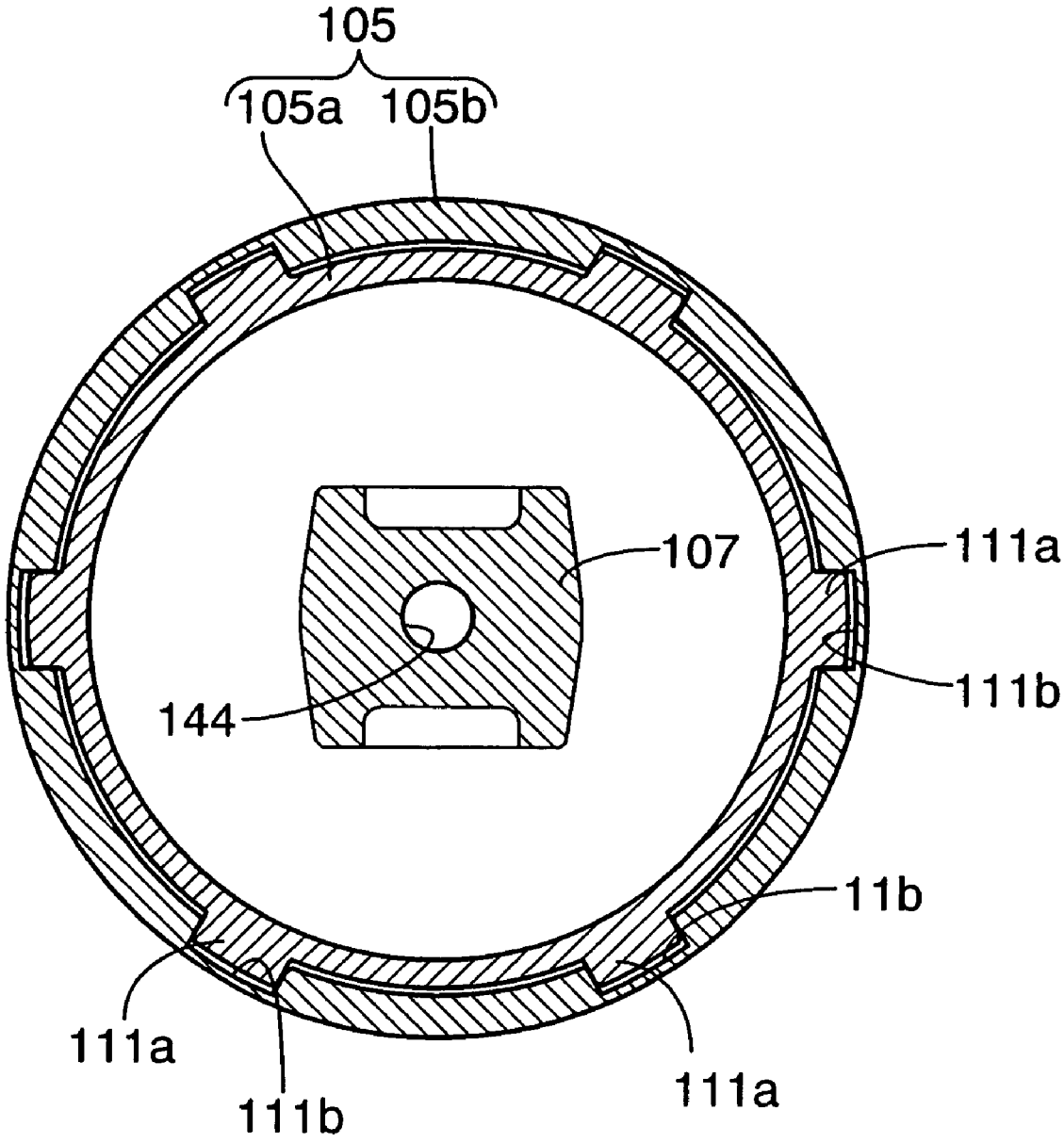
FIG. 13 is a sectional view taken along a line 13—13 in FIG. 12.
Figure 14:
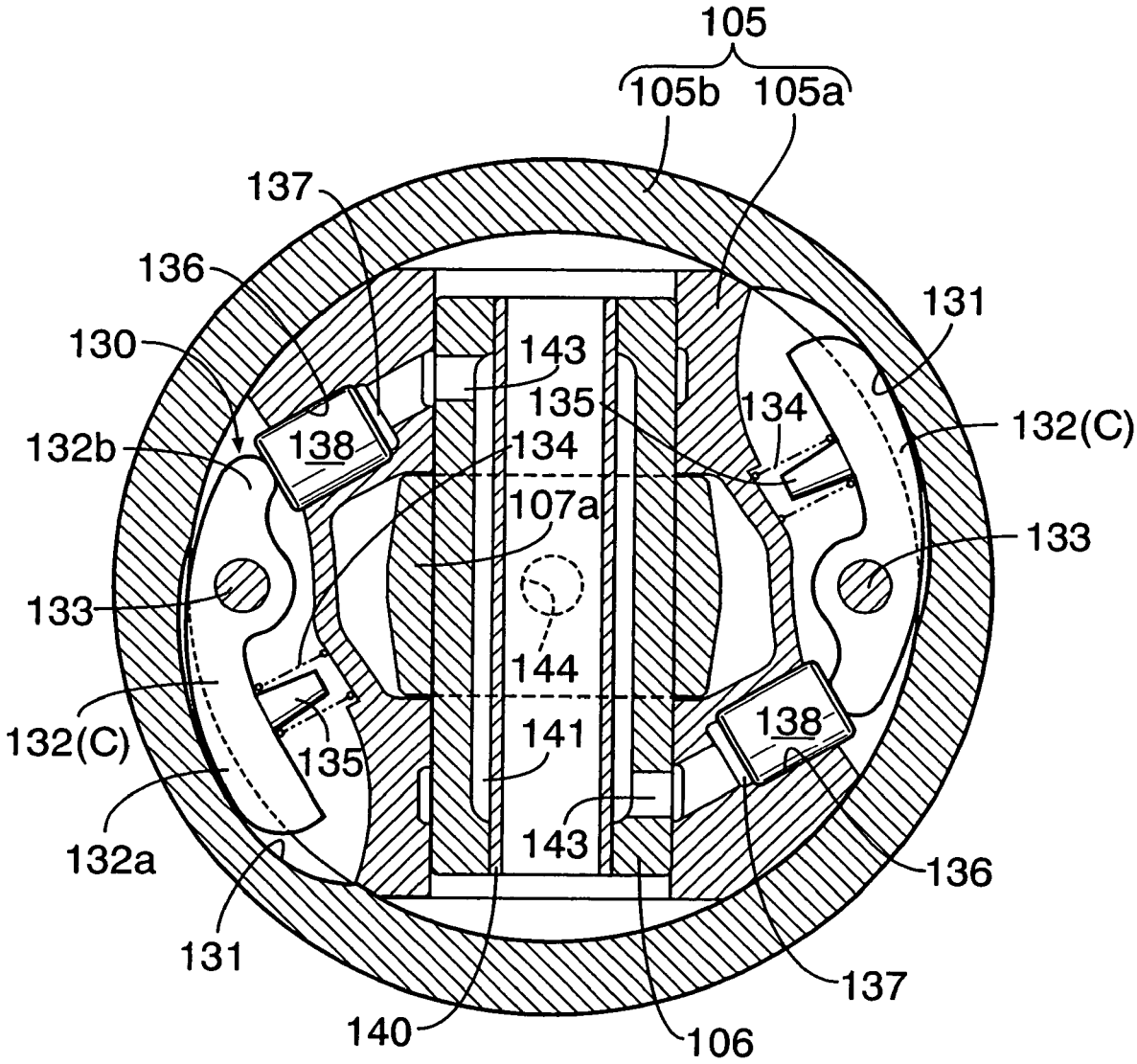
FIG. 14 is a sectional view taken along a line 14—14 in FIG. 12.

As shown in FIGS. 12 and 13, a plurality of spline teeth 111*a* and a plurality of spline grooves 111*b* are formed on slidably fitted surfaces of the piston inner and outer elements 5*a* and 5*b* respectively to extend in an axial direction of the piston 105 and engaged with each other, so that the piston inner and outer elements 105*a* and 105*b* cannot be rotated about their axes relative to each other.

Figure 17:
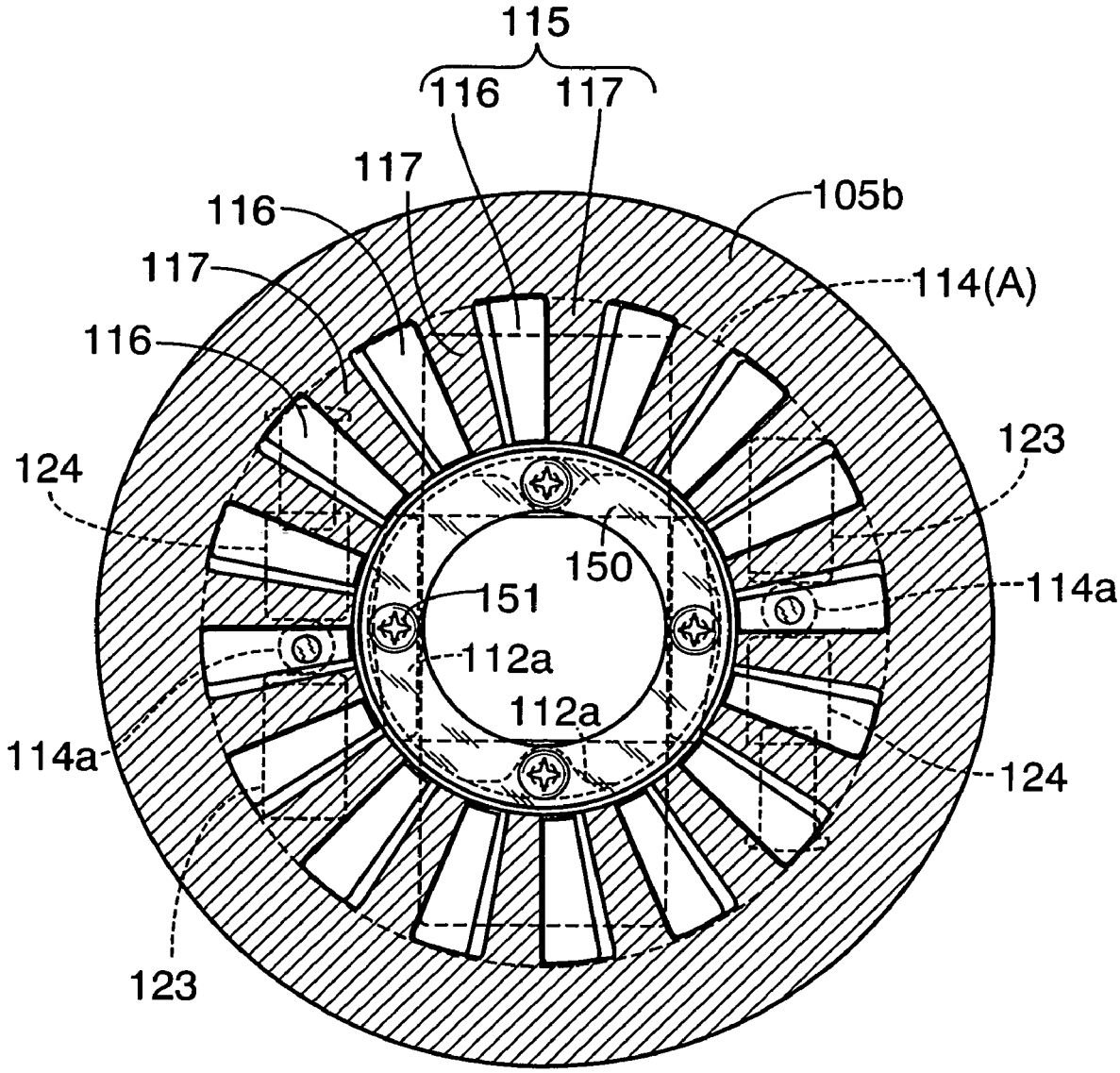
FIG. 17 is a sectional view taken along a line 17—17 in FIG. 12.
Figure 18:
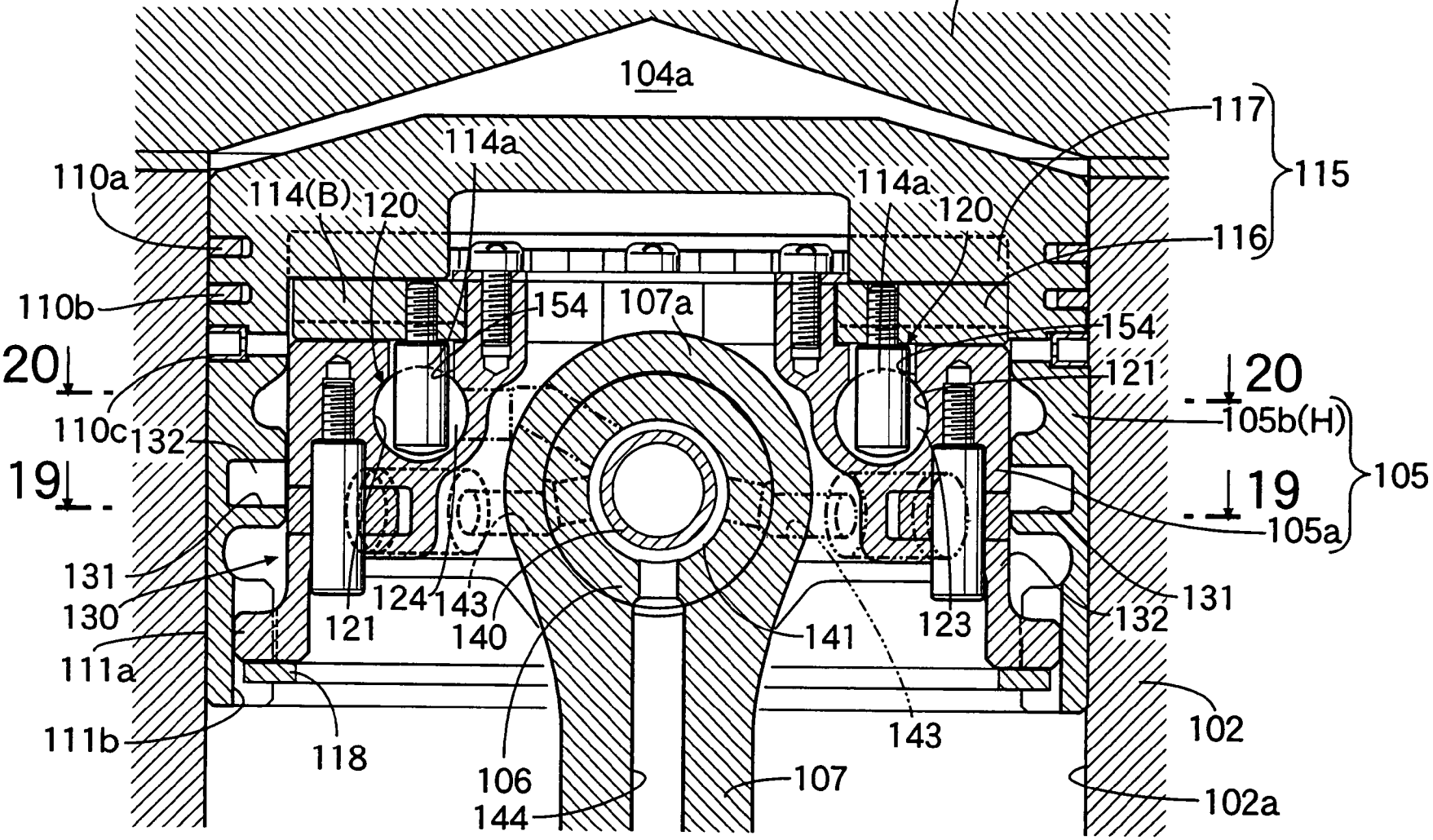
FIG. 18 is a view similar to FIG. 12, but showing a higher-compression ratio state.
Figure 19:
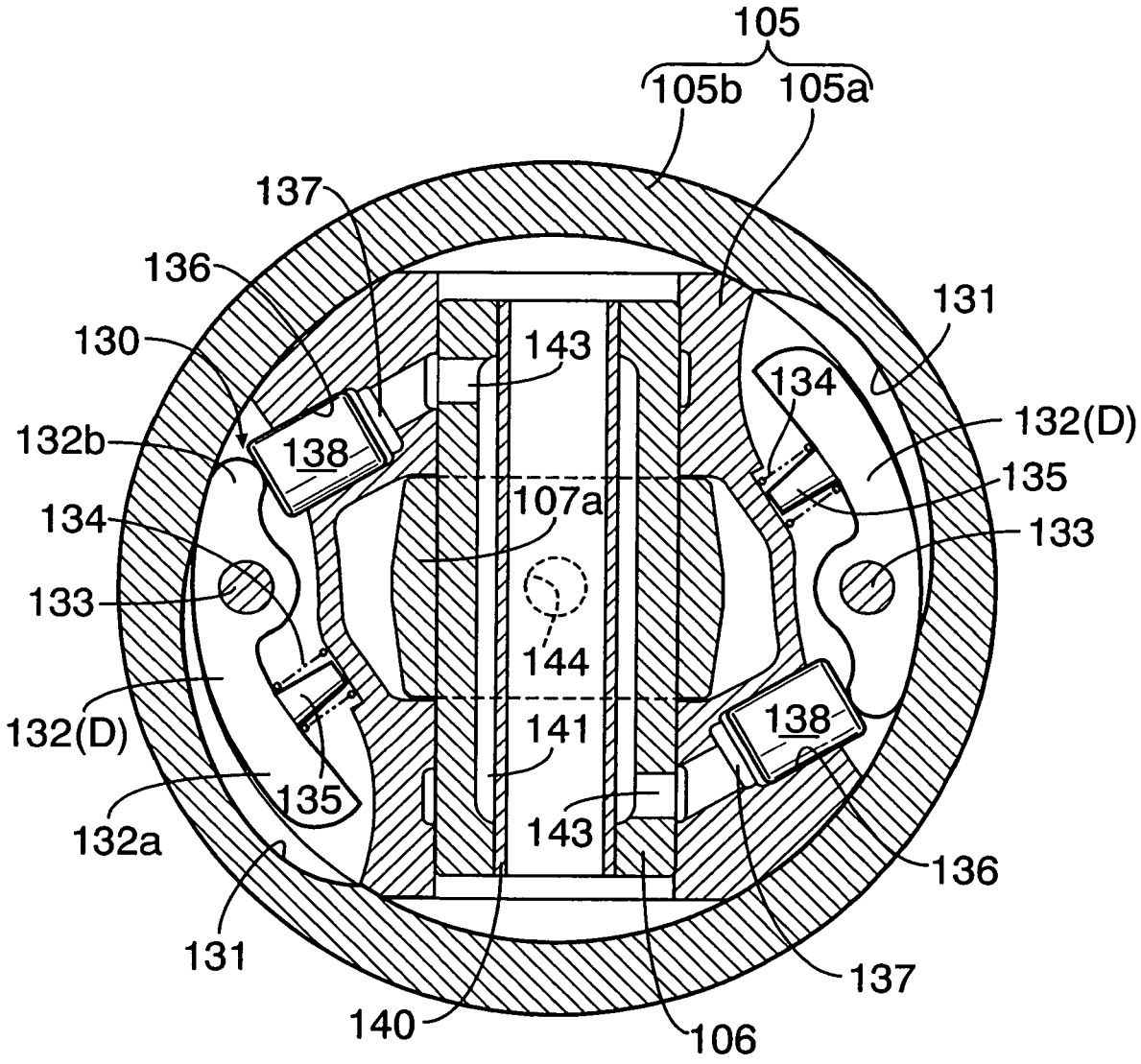
FIG. 19 is a sectional view taken along a line 19—19 in FIG. 18.

Referring to FIGS. 12 and 17, an annular bulking member 114 is placed on an upper surface of the piston inner element 105*a* and turnably fitted over a pivot 12 integrally and projectingly provided on such upper surface, and a retaining ring 150 is secured to an upper surface of the pivot 112 by a machine screw 151 for retain an upper surface of the bulking member 114 to inhibit the removal of the bulking member 114 from the pivot 112. The pivot 12 is divided into a plurality of (four in FIGS. 12 and 17) blocks 112*a*, 112*a* to receive the smaller end 107*a* of the connecting rod 107.

The bulking member 114 is capable of being turned between first and bulking positions A and B established about its axis, and a cam mechanism 115 is provided between the bulking member 114 and the piston outer element 105*b* and moves the piston outer element 105*b* alternately to a lower-compression ratio position L (see FIGS. 12 and 21A) close to the piston inner element 105*a* and a higher-compression ratio position H (see FIGS. 18 and 21C) close to the combustion chamber 104*a* in response to the reciprocal turning movement of the bulking member 114.

Figure 21A:
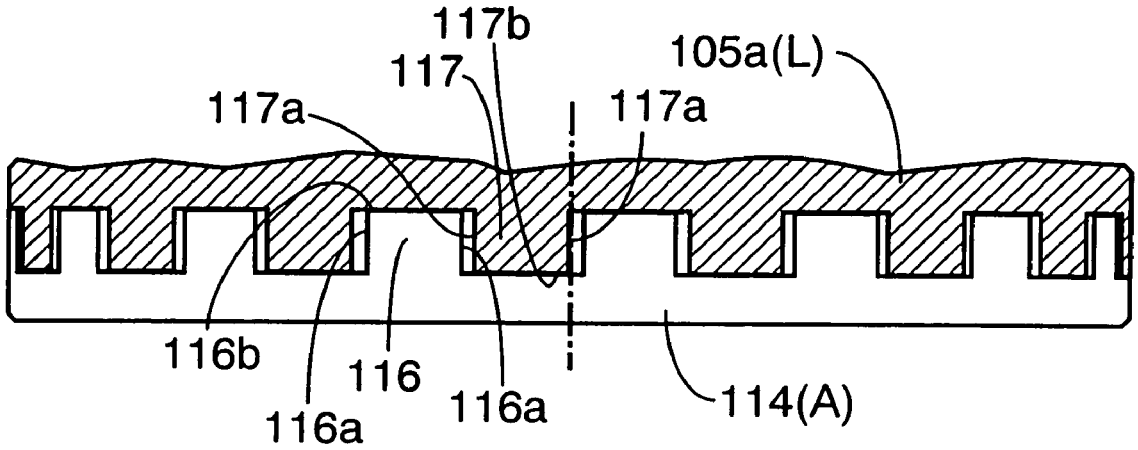
FIGS. 21A to 21C are diagrams for explaining the operation of a bulking member.
Figure 21B:
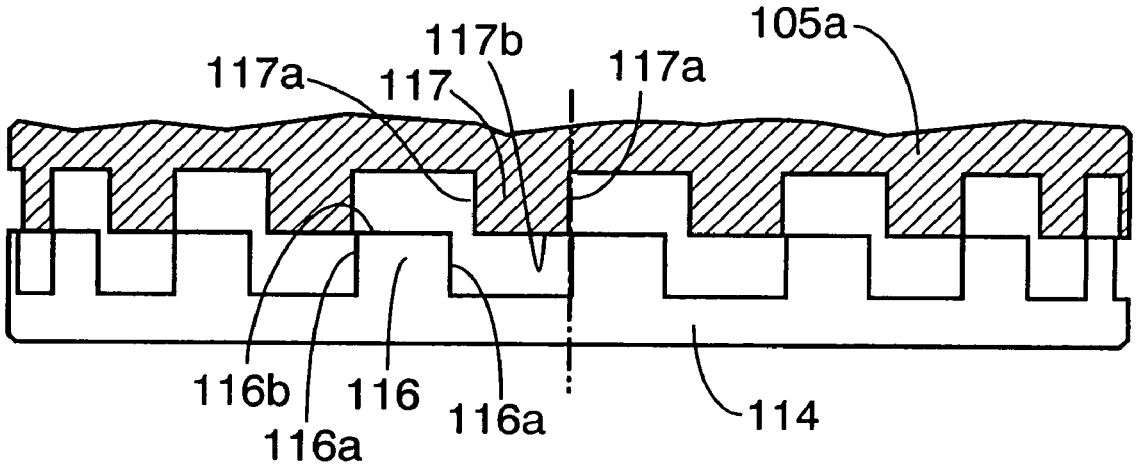
Figure 21C:
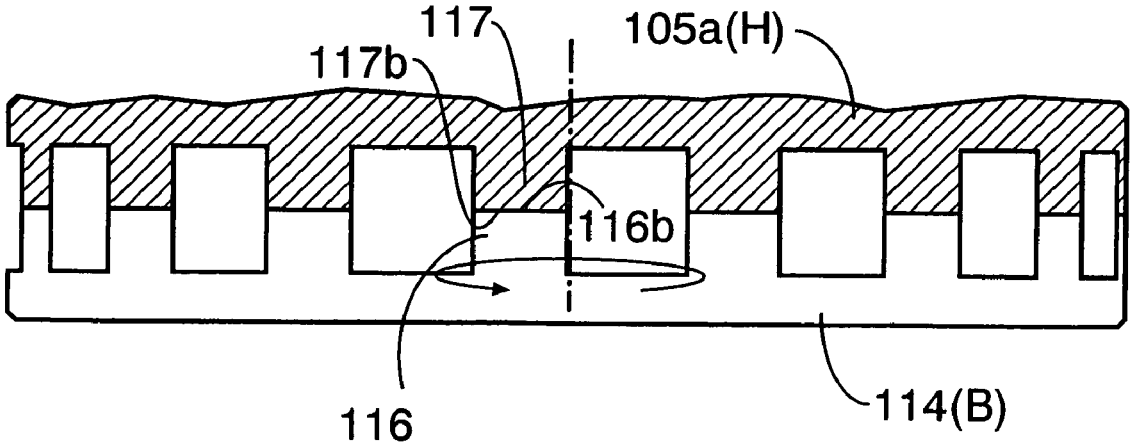

As best shown in FIGS. 21A to 21C, the cam mechanism 115 comprises a plurality of convex first cams 116 formed on an upper surface of the bulking member 114, and a plurality of convex second cams 117 formed on a lower surface of a top wall of the piston outer element 105*b*. The first and second cams 116 and 117 are formed so that they are arranged circumferentially alternately with each other to permit the movement of the piston outer element 105*b* to the lower-compression ratio position L, when the bulking member 114 is in the non-bulking position A. Each of the first cams 116 and each of the second cams 117 have opposite sides arranged in a circumferential direction of the bulking member 114, which are precipice faces 116*a* and 117*a* standing up substantially vertically from roots of the cams 116 and 117, and flat top faces 116*b* and 117*b* each of which connects both of upper edges of the precipice faces 116*a*, 117*a* to each other, and which are put into abutment against each other to retain the piston outer element 105*b* in the higher-compression ratio position H, when the bulking member 114 has reached the bulking position B. Since the opposite sides of the first and second cams 116 and 117 are the precipice faces 116*a* and 117*a*, as described above, the spacing between the adjacent cams 116, 117 arranged circumferentially can be narrowed, and the total area of the top faces 116*b*, 117*b* of the cams 116, 117 can be set remarkably larger than that in the first embodiment.

A stop ring 118 capable of abutting against a lower end face of the piston inner element 105*a* is locked to an inner peripheral surface of a lower end of the piston outer element 105*b*, and serves as a restricting means for inhibiting the further movement of the piston outer element 105*b* beyond the higher-compression ratio position H toward the combustion chamber 104*a*, when the piston outer element 105*b* has reached the higher-compression ratio position H.

Figure 15:
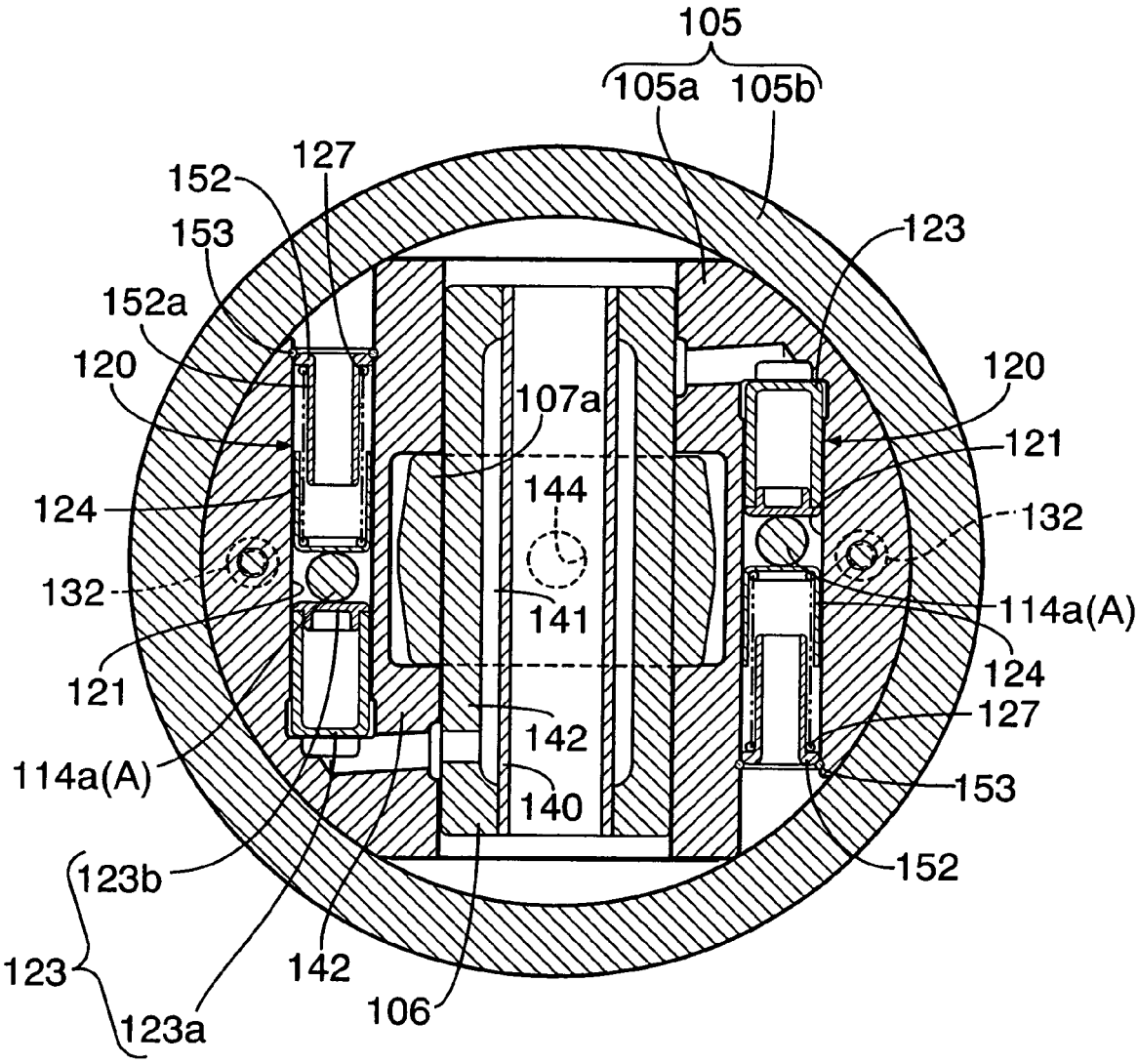
FIG. 15 is a sectional view taken along a line 15—15 in FIG. 12.
Figure 16:
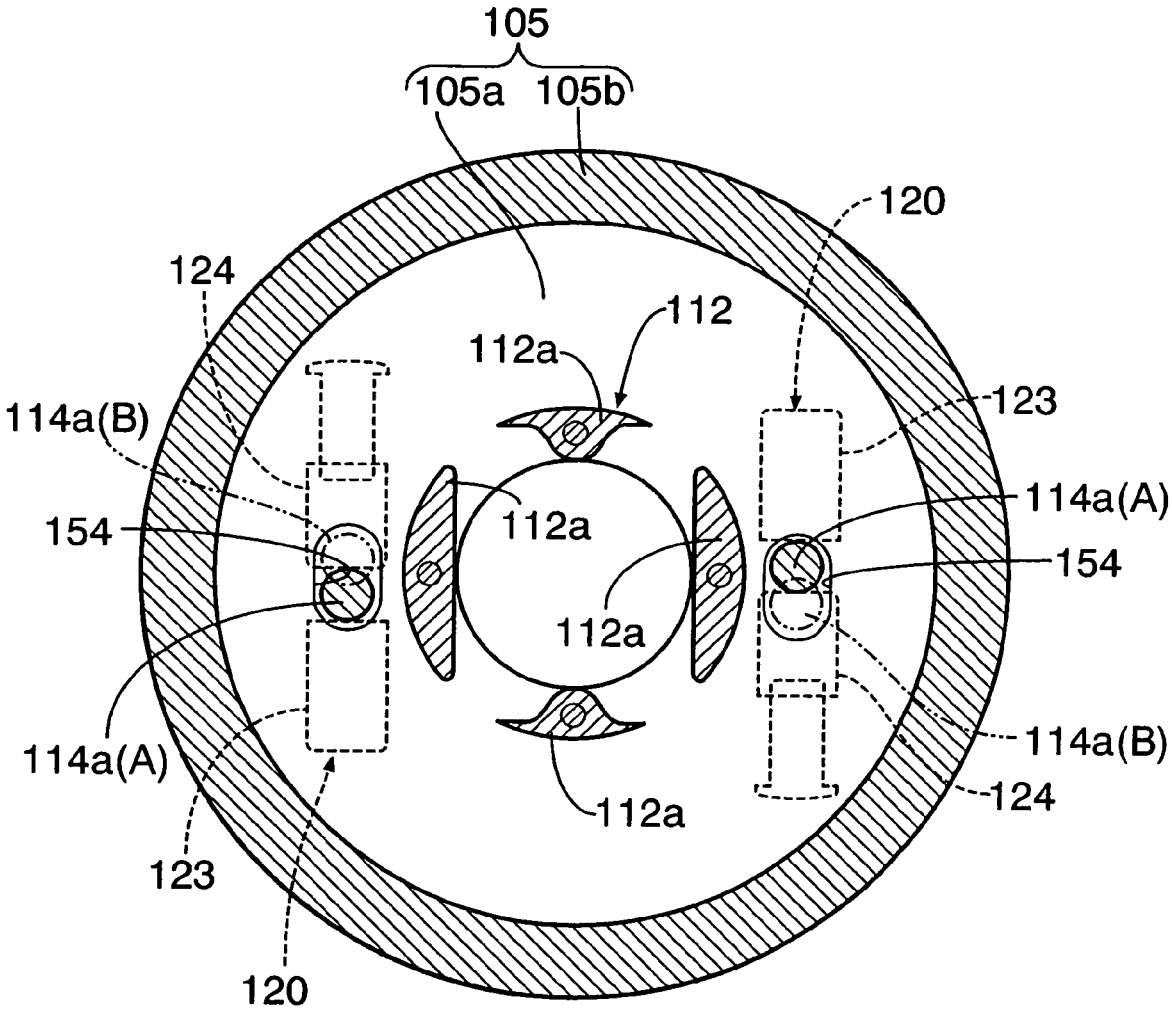
FIG. 16 is a sectional view taken along a line 16—16 in FIG. 12.

As best shown in FIGS. 12, 15 and 16, a plurality of sets (two sets in the illustrated embodiment) of actuators 120 for turning the bulking member 114 to the first and bulking positions A and B are mounted between the piston inner element 105*a* and the bulking member 114. The structure in which the actuators 120 are disposed in two sets will be described below.

A pair of bottomed cylinder bores 121, 121 are provided in the piston inner element 105*a* on opposite sides of the piston pin 106 to extend in parallel to the piston pin 106, and elongated bores 154, 154 are also provided in the piston inner element 105*a* to extend through upper walls of intermediate portions of the cylinder bores 121, 121. A pair of pressure-receiving pins 114*a*, 114*a* are integrally and projectingly provided on a lower surface of the bulking member 114 and arranged in a diametrical line on the bulking member 114, so that they face to the cylinder bores 121, 121 through the elongated bores 154, 154. The elongated bores 154, 154 are arranged so that they do not disturb the movement of the pressure-receiving pins 114*a*, 114*a* between the non-bulking position A and the bulking position B along with the bulking member 114.

Operating plungers 123, 123 and bottomed cylindrical returning plungers 124, 124 are slidably received in the cylinder bores 121, 121 on opposite sides of the corresponding pressure-receiving pins 114*a*, 114*a*. In this case, the operating plungers 123, 123 and the returning plungers 124, 124 are disposed point-symmetrically with respect to an axis of the piston 105.

A first hydraulic pressure chamber 125 is defined in a bottom of the cylinder bore 121, and an end of the operating plunger 23 opposite from the pressure-receiving pin 114*a* faces to the first hydraulic pressure chamber 125, so that when a hydraulic pressure is supplied to the chamber 125, the operating plunger 23 receives such hydraulic pressure to turn the bulking member 114 to the bulking position B through the corresponding the pressure-receiving pin 114*a*. The first hydraulic pressure chamber 125 is connected to an oil passage 144 (see FIG. 11) through a first distributing oil passage 142 and an oil chamber 141, and the oil passage 144 is connected switchably to an oil pump-146 as a hydraulic pressure source and an oil reservoir 147 through a solenoid switchover valve 145.

Spring-retaining rings 152, 152 are locked in open ends of the cylinder bores 121, 121 by stop rings 153, 153, and return springs 127, 127 comprising coil springs are mounted under compression between the spring-retaining rings 152, 152 and the returning plungers 124, 124 for biasing the returning plungers 124, 124 toward the pressure-receiving pins 114*a*, 114*a*, respectively. Thus, the returning plungers 124, 124 can turn the bulking member 114 to the non-bulking position A through the pressure-receiving pins 114*a*, 114*a* by biasing forces of the return spring 127, 127.

Each of the operating plungers 123 is formed into a hollow shape by a cup-shaped plunger body 123*a* and a cap 123*b* made of a hard material and press-fitted into and secured in an open end of the plunger body 123*a* in order to reduce the weight of the operating plunger 123. The operating plunger 123 is disposed so that the cap 123*b* thereof is in abutment against the pressure-receiving pin 114*a*. Each of the returning plungers 124 is also of a cap-shape in order to reduce the weight of the returning plunger 124 and disposed so that its bottom wall is in abutment against the pressure-receiving pin 114*a*.

Each of the spring-retaining rings 152 has a cylindrical skirt portion 152*a* located inside the return spring 127 and extending into the returning plunger 124, whereby the buckling of the return spring 127 can be prevented.

Figure 20:
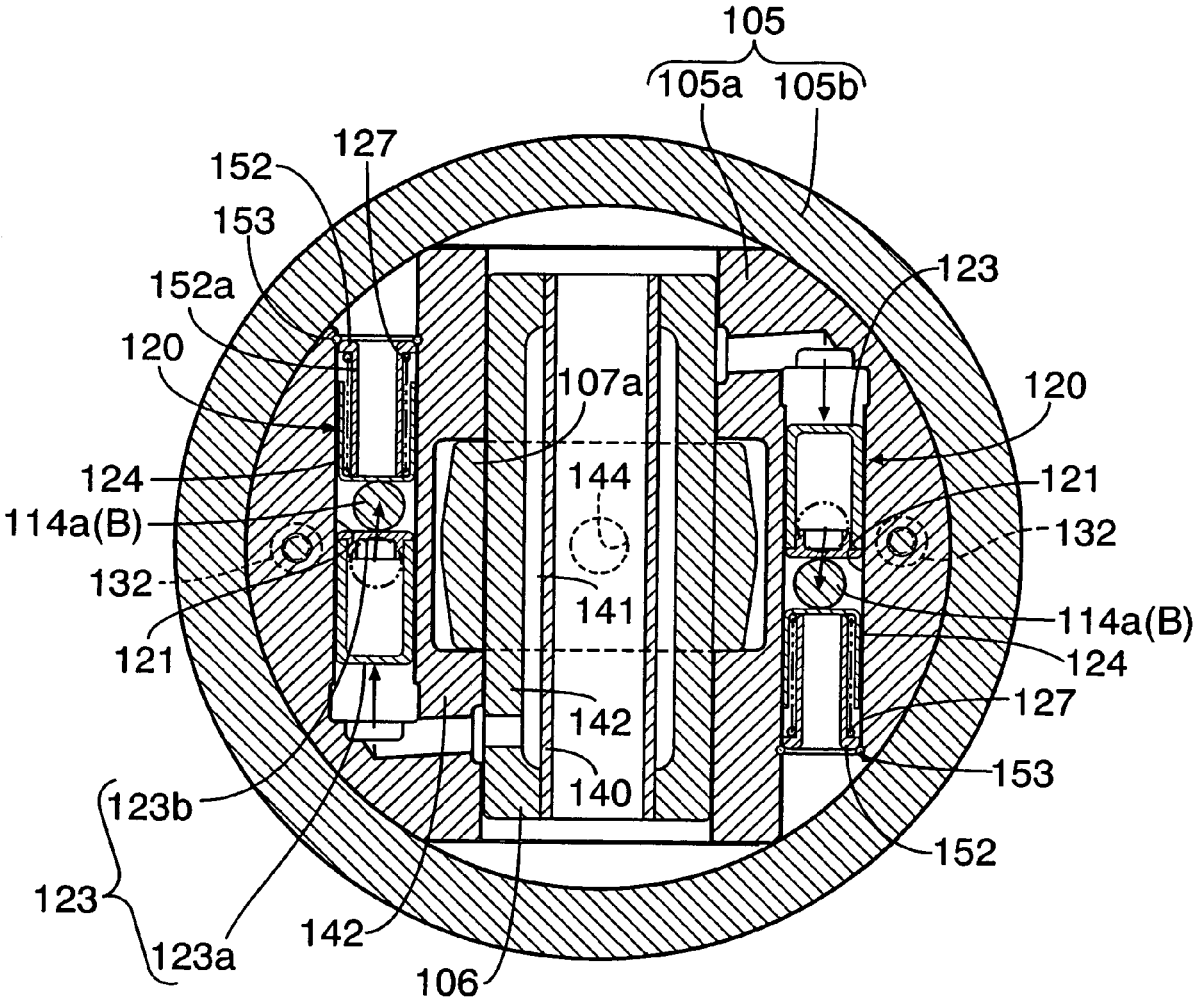
FIG. 20 is a sectional view taken along a line 20—20 in FIG. 18.

The non-bulking position A of the bulking member 114 is defined by the abutment of the pressure-receiving pins 114*a*, 114*a* against tip ends of the operating plungers 123, 123 abutting against bottom surfaces of the cylinder bores 121, 121 (see FIG. 15), and the bulking position B of the bulking member 114 is defined by the abutment of the pressure-receiving pin 114*a* against the tip end of the returning plunger 24 abutting against the skirt portion 152*a* of the spring-retaining ring 152 (see FIG. 20). Thus, in the non-bulking position A of the bulking member 114, the side contact of the adjacent first and second cams 116 and 117 can be avoided, and the smooth movement of the piston outer element 105*b* toward the higher-compression ratio position H can be achieved.

The constructions of other members such as a piston outer element locking means 130 are the same as those in the first embodiment and hence, portions or components in FIGS. 11 to 21C corresponding to those in the first embodiment are designated by like reference characters comprising 100 added to the numerals used in the first embodiment, and the description of them is omitted.

In the second embodiment, the movements of the piston outer element 105*b* from the lower-compression ratio position L to the higher-compression ratio position H and from the higher-compression ratio position H to the lower-compression ratio position L are carried out by utilizing only the above-described natural external forces applied to the piston inner and outer elements 105*a* and 105*b* to move them axially away from and toward each other during the reciprocal movement of the piston 105 (see FIG. 21B). Therefore, if the actuator 120 merely exhibits an output enough to move the bulking member 114 between the non-bulking position A and the bulking position B, as shown in FIG. 21C, it suffices, and hence, reductions in capacity and size of the actuator 120 can be provided.

In each of the first and second cams 116 and 117, its opposite sides arranged in a sliding direction can be formed as precipice faces 116*a*, 117*a*, and it is possible to set the operational stroke angle of the bulking member 114 at a small value and to form the top faces 116*b* and 117*b* of the cams 116 and 117 in a large extent in correspondence to that the slants 16*a* and 17*a* are not provided as in the first embodiment. In addition, it is possible to enhance the responsiveness of the bulking member 114 and to reduce the surface pressures applied to the top faces 116*b* and 117*b* to enhance the durability thereof.

As shown in FIGS. 15 and 16, the plurality of sets of actuators 120 for operating the bulking member 114 are disposed at equal distances and hence, the bulking member 114 can be turned smoothly about the pivot 112 without application of an unbalanced load thereto. Moreover, a total output from the plurality of sets of actuators 120 is large and hence, it is possible to provide a reduction in capacity and in its turn, a reduction in size of the actuator 120 in each set.

In addition, the operating plunger 123 and the returning plunger 124 which are components for the actuator 120 in each set are received in the common cylinder bore 121 defined in the piston inner element 105*a* and hence, the structure is simple, and the provision of the bore by working is simple, which can contribute to a reduction in cost.

When the actuators 120 are disposed in two sets, the respective cylinder bore 121, 121 are defined in the piston inner element 105*a* in parallel to the piston pin 106. Therefore, the two sets of actuators 120, 120 can be disposed at equal distances in the circumferential direction of the piston 105 without being interfered by the piston pin 106.

The axes of the operating and returning plungers 123 and 124 are disposed to intersect, at substantially right angles, a radial line of the pivot 112 traversing the axis of each pressure-receiving pin 114*a*. Therefore, pushing forces of the operating and returning plungers 123 and 124 can be transmitted efficiently to the bulking member 114 through the pressure-receiving pins 114*a* to contribute to the compactness of the actuators 120.

Each of the end faces of the operating and returning plungers 123 and 124 and the cylindrical outer peripheral surface of each of the pressure-receiving pins 114*a* are in line contact with each other and hence, the contact area is wide, as compared with that in the first embodiment, thereby providing a reduction in surface pressure and contributing to an enhancement in durability.

It will be understood that the present invention is not limited to the above-described embodiments, and various modifications in design may be made without departing from the spirit and scope of the invention defined in claims. For example, the operating mode of the solenoid switchover valve 45, 145 may be reverse from that in each of the above-described embodiments. More specifically, in the non-energized state of the switchover valve 45, 145, the oil passage 44, 144 may be connected to the oil pump 46, 146, and in the energized state of the switchover valve 45, 145, the oil passage 44, 144 may be connected to the oil reservoir 47, 147.

What is claimed is:

1. A compression ratio changing device in an internal combustion engine, comprising:

a piston inner element to a connecting rod through a piston pin, a piston outer element which is fitted over an outer periphery of said piston inner element for sliding movement only in an axial direction with respect to the piston inner element, with an outer end face of the piston outer element exposed to a combustion chamber, said piston outer element capable of being moved between a lower-compression ratio position (L) close to said piston inner element and a higher-compression ratio position (H) close to said combustion chamber, a bulking member interposed between said piston inner and outer elements and capable of being moved between a non-bulking position (A) where said bulking member permits the movement of said piston outer element to the lower-compression ratio position (L), and a bulking position (B) where said piston outer element retained in the higher-compression ratio position, and an actuator for operating said bulking member alternately in the non-bulking position (A) and the bulking position (B), wherein said bulking member and said actuator are constructed so that said piston outer element is permitted to be moved, during reciprocal movements of said piston inner and outer elements, between the lower-compression ratio position (L) and the higher-compression ratio position (H) by natural external forces applied to said piston inner and outer elements to move these elements axially away from and toward each other, and wherein said bulking member is interposed between said piston inner and outer elements so as to be capable of turning about axes of said piston inner and outer elements between the non-bulking position (A) and the bulking position (B), and a first cam and a second cam are formed into a convex shape on axially opposed surfaces of said bulking member and one of said piston inner and outer elements, and have flat top faces for abutting against each other, when said bulking member has reached the bulking position (B), and precipice faces extending downwards substantially vertically from circumferentially opposite side edges of said top faces to roots of the cams.

2. The compression ratio changing device in an internal combustion engine according to claim 1, wherein said bulking member is interposed between said piston inner and outer elements so as to be capable of turning about axes of said piston inner and outer elements between the non-bulking position (A) and the bulking position (B), and a first cam and a second cam are formed into a convex shape on axially opposed surfaces of said bulking member and one of said piston inner and outer elements, and have slants for slipping on each other axially away from each other, when said bulking member is turned from the non-bulking position (A) to the bulking position (B), and flat top faces abutting against each other, when said bulking member has reached the bulking position (B).

3. The compression ratio changing device in an internal combustion engine according to claim 1, further including a piston outer element locking means provided between said piston inner element and said piston outer element for locking said piston outer element relative to said piston inner element when said piston outer element has reached the lower-compression ratio position (L).

4. The compression ratio changing device in an internal combustion engine according to claim 1, further including a piston outer element restricting means provided between said piston inner element and said piston outer element for restricting the movement of said piston outer element relative to said piston inner element toward said combustion chamber, when said piston outer element has reached the higher-compression ratio position (H).

5. The compression ratio changing device in an internal combustion engine according to claim 1, wherein said actuator comprises a hydraulically operating means operated by a hydraulic pressure from a hydraulic pressure source to operate said bulking member to the bulking position (B), and a return spring for biasing said bulking member toward the non-bulking position (A).

6. The compression ratio changing device in an internal combustion engine according to claim 1, further comprising piston outer element locking means including a locking member supported on said piston inner element to be moved between an operated position (C), where said locking member is in engagement in a locking groove in an inner peripheral surface of said piston outer element and a retracted position, and where said locking member is out of engagement in said locking groove, an operating spring for biasing said locking member toward the operated position (C), and a hydraulically returning means operated by a hydraulic pressure from a hydraulic pressure source to operate said locking member toward the retracted position (D).

7. The compression ratio changing device in an internal combustion engine according to claim 1, wherein said actuator comprises hydraulically operating means operated by a hydraulic pressure from a hydraulic pressure source to operate said bulking member to the bulking position (B), a returning spring for biasing said bulking member toward the non-bulking position (A), and a piston outer element locking means comprises including a locking member supported on said piston inner element to be moved between an operated position, (C) where said locking member is in engagement in a locking groove in an inner peripheral surface of said piston outer element and a retracted position (D), where said locking member is out of engagement in said locking groove, an operating spring for biasing said locking member toward an operated position (C), and hydraulically returning means operated by the hydraulic pressure from said hydraulic pressure source to operate said locking member toward the retracted position (D), so that the hydraulic pressure in said hydraulic pressure source is supplied simultaneously to said hydraulically operating means and said hydraulically returning means.

8. The compression ratio changing device in an internal combustion engine according to claim 1, wherein said actuators are disposed in a plurality of sets in a circumferential direction of said bulking member.

9. The compression ratio changing device in an internal combustion engine according to claim 8, wherein said actuators are disposed in the plurality of sets at equal distances in the circumferential direction of said bulking member.

10. The compression ratio changing device in an internal combustion engine according to claim 8, wherein said actuators are disposed in two sets on opposite sides of said piston pin.

11. A compression ratio changing device in an internal combustion engine according to claim 1, wherein said actuator comprises an operating member and a returning member which are slidably disposed in said piston inner element on the same axis extending in a direction of turning of said bulking member and are opposed to each other on opposite sides of a pressure-receiving portion of said bulking member, so that said bulking member is turned alternately to the non-bulking position (A) and the bulking position (B) by alternately operating said operating member and said returning member.

12. The compression ratio changing device in an internal combustion engine according to claim 11, wherein said operating member and said returning member comprise an operating plunger and a returning plunger, respectively, which are slidably received in a common cylinder bore defined in said piston inner element and are opposed to each other on opposite sides of said pressure-receiving portion.

13. The compression ratio changing device in an internal combustion engine according to claim 11, wherein said operating member and said returning member are disposed on the same axis intersecting, at substantially right angles, a radial line of said bulking member extending through the center of said pressure-receiving portion.

14. The compression ratio changing device in an internal combustion engine according to claim 11, wherein said actuators are disposed in a plurality of sets at equal distances in a circumferential direction of said bulking member.

15. The compression ratio changing device in an internal combustion engine according to claim 11, wherein said actuators are disposed in two sets on opposite sides of said piston pin.

16. A compression ratio changing device in an internal combustion engine, comprising:

a piston inner element connected to a connecting rod through a piston pin, a piston outer element which is fitted over an outer periphery of said piston inner element for sliding movement only in an axial direction with respect to the piston inner element, with an outer end face of the piston outer element exposed to a combustion chamber, said piston outer element capable of being moved between a lower-compression ratio position (L) close to said piston inner element and a higher-compression ratio position (H) close to said combustion chamber, a bulking member interposed between said piston inner and outer elements and capable of being moved between a non-bulking position (A) where said bulking member permits the movement of said piston outer element to the lower-compression ratio position (L), and a bulking position (B) where said piston outer element is retained in the higher-compression ratio position, and an actuator for operating said bulking member alternately in the non-bulking position (A) and the bulking position (B), wherein said actuator comprises an operating member and a returning member which are slidably disposed in said piston inner element on the same axis extending in a direction of turning of said bulking member and are opposed to each other on opposite sides of a pressure-receiving portion of said bulking member, so that said bulking member is turned alternately to the non-bulking position (A) and the bulking position (B) by alternately operating said operating member and said returning member, wherein said operating member and said returning member comprise an operating plunger and a returning plunger, respectively, which are slidably received in a common cylinder bore defined in said piston inner element and are opposed to each other on opposite sides of said pressure-receiving portion.

17. A compression ratio changing device in an internal combustion engine, comprising:

a piston inner element connected to a connecting rod through a piston pin, a piston outer element which is fitted over an outer periphery of said piston inner element for sliding movement only in an axial direction with respect to the piston inner element, with an outer end face of the piston outer element exposed to a combustion chamber, said piston outer element capable of being moved between a lower-compression ratio position (L) close to said piston inner element and a higher-compression ratio position (H) close to said combustion chamber, a bulking member interposed between said piston inner and outer elements and capable of being moved between a non-bulking position (A) where said bulking member permits the movement of said piston outer element to the lower-compression ratio position (L), and a bulking position (B) where said piston outer element is retained in the higher-compression ratio position, and an actuator for operating said bulking member alternately in the non-bulking position (A) and the bulking position (B), wherein said actuator comprises an operating member and a returning member which are slidably disposed in said piston inner element on the same axis extending in a direction of turning of said bulking member and are opposed to each other on opposite sides of a pressure-receiving portion of said bulking member, so that said bulking member is turned alternately to the non-bulking position (A) and the bulking position (B) by alternately operating said operating member and said returning member, and wherein said actuators are disposed in a plurality of sets at equal distances in a circumferential direction of said bulking member.

18. A compression ratio changing device in an internal combustion engine according to claim 16, wherein said bulking member and said actuator are constructed so that said piston outer element is permitted to be moved, during reciprocal movements of said piston inner and outer elements, between the lower-compression ratio position (L) and the higher-compression ratio position (H) by natural external forces applied to said piston inner and outer elements to move these elements axially away from and toward each other.

19. A compression ratio changing device in an internal combustion engine, comprising a piston inner element connected to a connecting rod through a piston pin, a piston outer element which is fitted over an outer periphery of said piston inner element for sliding movement only in an axial direction with respect to the piston inner element, with an outer end face of the piston outer element exposed to a combustion chamber, said piston outer element capable of being moved between a lower-compression ratio position (L) close to said piston inner element and a higher-compression ratio position (H) close to said combustion chamber, a bulking member interposed between said piston inner and outer elements and capable of being moved between a non-bulking position (A) where said bulking member permits the movement of said piston outer element to the lower-compression ratio position (L), and a bulking position (B) where said piston outer element is retained in the higher-compression ratio position (H), and an actuator for operating said bulking member alternately in the non-bulking position (A) and the bulking position (B), wherein a cam mechanism is provided between axially opposed surfaces of the bulking member and one of said piston inner and outer elements said cam mechanism comprising a first cam structure provided on said bulking member and having first projections and first recesses, and a second cam structure provided on said one of the piston inner and outer elements and having second projections and second recesses, said first projections projecting toward said one of the piston inner and outer elements in the axial direction, said second projections projecting toward said bulking member in the axial direction, and wherein at said non-bulking position (A) top faces of the first and second projections are placed in abutment against root faces of the recesses of the opponent cam structures, respectively, in the axial direction, whereas at said bulking position (B) the top faces of the first and second projections of the first and second cam structures are placed in abutment against each other, so that at least a load acting in the axial direction from the piston outer element to the piston inner element during operation of the engine is received by the abutment between the first and second cam structures.

20. The compression ratio changing device in an internal combustion engine according to claim 19, wherein said bulking member and said actuator are constructed so that said piston outer element is permitted to be moved, during reciprocal movements of said piston inner and outer elements between the lower-compression ratio position (L) and the higher-compression ratio position (H) by natural external forces applied to said piston inner and outer elements to move these elements axially away from and toward each other.

21. The compression ratio changing device in an internal combustion engine according to claim 19, wherein said bulking member is capable of turning about axes of said piston inner and outer elements between the non-bulking position (A) and the bulking position (B), and said first and second cam structures have slants extending between said projections and said recesses, respectively, for slipping on each other axially away from each other, when said bulking member is turned from the non-bulking position (A) to the bulking position (B).

22. The compression ratio changing device in an internal combustion engine according to claim 20, wherein said bulking member is capable of turning about axes of said piston inner and outer elements between the non-bulking position (A) and the bulking position (B), and said first and second cam structures have precipice faces (116*a*, 117*a*), respectively, extending downwards substantially vertically from circumferentially opposite side edges of said top faces to the bottom faces of the recesses.

23. The compression ratio changing device in an internal combustion engine according to claim 19, further including a piston outer element locking means provided between said piston inner element and said piston outer element for locking said piston outer element relative to said piston inner element, when said piston outer element has reached the lower-compression ratio position (L).

24. The compression ratio changing device in an internal combustion engine according to claim 19, further including a piston outer element restricting means provided between said piston inner element and said piston outer element for restricting the movement of said piston outer element relative to said piston inner element toward said combustion chamber, when said piston outer element has reached the higher-compression ratio position (H).

25. The compression ratio changing device in an internal combustion engine according to claim 19, wherein said actuator comprises a hydraulically operating means operated by a hydraulic pressure from a hydraulic pressure source to operate said bulking member to the bulking position (B) and a return spring for biasing said bulking member toward the non-bulking position (A).

26. The compression ratio changing device in an internal combustion engine according to claim 19, further comprising a piston outer element locking means including a locking member supported on said piston inner element to be moved between an operated position (C) where said locking member is in engagement in a locking groove in an inner peripherol surface of said piston outer element and a retracted position (D) where said locking member is out of engagement in said locking groove, an operating spring for biasing said locking member toward the operated position (C), and a hydraulically returning means operated by a hydraulic pressure from said hydraulic pressure source to operate said locking member toward the retracted position (D).

27. The compression ratio changing device in an internal combustion engine according to claim 19, wherein said actuator comprises a hydraulically operating means operated by a hydraulic pressure from a hydraulic pressure source to operate said bulking member to the bulking position (B), and a returning spring for biasing said bulking member toward the non-bulking position (A), and a piston outer element locking means comprises a locking member supported on said piston inner element to be moved between an operated position (C) where said locking member is in engagement in a locking groove in an inner peripheral surface of said piston outer element and a retracted position (D) where said locking member is out of engagement in said locking groove, an operating spring for biasing said locking member toward the operated position, and a hydraulically returning means operated by the hydraulic pressure from said hydraulic pressure source to operate said locking member toward the retracted position (D), so that the hydraulic pressure in said hydraulic pressure source is supplied simultaneously to said hydraulically operating means and said hydraulically returning means.

28. The compression ratio changing device in an internal combustion engine according to claim 19, wherein said actuators are disposed in a plurality of sets in a circumferential direction of said bulking member.

29. The compression ratio changing device in an internal combustion engine according to claim 28, wherein said actuators are disposed in the plurality of sets at equal distances in the circumferential direction of said bulking member.

30. The compression ratio changing device in an internal combustion engine according to claim 28, wherein said actuators are disposed in two sets on opposite sides of said piston pin.

31. The compression ratio changing device in an internal combustion engine according to claim 19, wherein said actuator comprises an operating member and a returning member which are slidably disposed in said piston inner element on the same axis extending in a direction of turning of said bulking member and are opposed to each other on opposite sides of a pressure-receiving portion of said bulking member, so that said bulking member is turned alternately to the non-bulking position (A) and the bulking position (B) by alternately operating said operating member and said returning member.

32. The compression ratio changing device in an internal combustion engine according to claim 31, wherein said operating member and said returning member comprise an operating plunger and a returning plunger, respectively, which are slidably received in a common cylinder bore defined in said piston inner element and are opposed to each other on opposite sides of said pressure-receiving portion.

33. The compression ratio changing device in an internal combustion engine according to claim 31, wherein said operating member and said returning member are disposed on the same axis intersecting, at substantially right angles, a radial line of said bulking member extending through the center of said pressure-receiving portion.

34. The compression ratio changing device in an internal combustion engine according to claim 31, wherein said actuators are disposed in a plurality of sets at equal distances in a circumferential direction of said bulking member.

35. The compression ratio changing device in an internal combustion engine according to claim 31, wherein said actuators are disposed in two sets on opposite sides of said piston pin.

36. The compression ratio changing device in an internal combustion engine according to claim 19, wherein said bulking member is provided on the other of said piston inner and outer elements relatively rotatably in a circumferential direction and said cam mechanism is operated in response to a relative rotation of the bulking member with respect to said other of the piston of the piston outer element with respect to the piston inner element in the axial direction.

37. A compression ratio changing device in an internal combustion engine, comprising a piston inner element connected to a connecting rod through a piston pin, a piston outer element which is fitted over an outer periphery of said piston inner element for sliding movement only in an axial direction with respect to the piston inner element, with an outer end face of the piston outer element exposed to a combustion chamber, said piston outer element capable of being moved between a lower compression ratio position (L) close to said piston inner element and a higher-compression ratio position (H) close to said combustion chamber, a bulking member interposed between said piston inner and outer elements and provided on one of said piston inner and outer elements so as to be rotatable relative to said one of the piston inner and outer elements in a circumferential direction around the piston axis between a non-bulking position (A) where said bulking member permits the movement of said piston outer element to the lower-compression ratio position (L), and a bulking position (B) where said piston outer element is retained in the higher-compression ratio position (H), and an actuator for operating said bulking member alternately in the non-bulking position (A) and the bulking position (B), wherein a device is provided for changing relative axial positions of said piston inner and outer elements with respect to each other in response to a relative rotation of the bulking member with respect to said one of the piston inner and outer elements in the circumferential direction.

38. The compression ratio changing device in an internal combustion engine according to claim 37, wherein said bulking member and said actuator are constructed so that said piston outer element is permitted to be moved, during reciprocal movements of said piston inner and outer elements, between the lower-compression ratio position (L) and the higher-compression ratio position (H) by natural external forces applied to said piston inner and outer elements to move these elements axially away from and toward each other.

39. The compression ratio changing device in an internal combustion engine according to claim 37, wherein said device for changing relative axial positions of said piston inner and outer elements comprises a first cam and a second cam which are formed into a convex shape on axially opposed surfaces of said bulking member and the other of said piston inner and outer elements, said first and second cams having slants for slipping on each other axially away from each other, when said bulking member is turned from the non-bulking position (A) to the bulking position (B), and flat top faces for abutting against each other, when said bulking member has reached the bulking position (B).

40. The compression ratio changing device in an internal combustion engine according to claim 38, wherein said device for changing relative axial positions of said piston inner and outer elements comprises a first cam and a second cam which are formed into a convex shape on axially opposed surfaces of said bulking member and the other of said piston inner and outer elements, said first and second cams having flat top faces for abutting against each other, when said bulking member has reached the bulking position (B), and precipice faces extending downwards substantially vertically from circumferentially opposite side edges of said top faces to roots of the cams.

41. The compression ratio changing device in an internal combustion engine according to claim 37, further including a piston outer element rocking means provided between said piston inner element and said piston outer element for locking said piston outer element relative to said piston inner element, when said piston outer element has reached the lower-compression ratio position (L).

42. The compression ratio changing device in an internal combustion engine according to claim 37, further including a piston outer element restriction means provided between said piston inner element and said piston outer element for restricting the movement of said piston outer element relative to said piston inner element toward said combustion chamber, when said piston outer element has reached the higher-compression ratio position (H).

43. The compression ratio changing device in an internal combustion engine according to claim 37, wherein said actuator comprises a hydraulically operating means operated by a hydraulic pressure from a hydraulic pressure source to operate said bulking member to the bulking position (B), and a return spring for biasing said bulking member toward the non-bulking position (A).

44. The compression ratio changing device in an internal combustion engine according to claim 37, further comprising a piston outer element locking means including a locking member supported on said piston inner element to be moved between an operated position (C) where said locking member is in engagement in a locking groove in an inner peripheral surface of said piston outer element and a retracted position (D) where said locking member is out of engagement in said locking groove, an operating spring for biasing said locking member toward the operated position (C), and a hydraulically returning means operated by a hydraulic pressure from said hydraulic pressure source to operate said locking member toward the retracted position (D).

45. The compression ratio changing device in an internal combustion engine according to claim 37, wherein said actuator comprises a hydraulically operating means operated by a hydraulic pressure from a hydraulic pressure source to operate said bulking member to the bulking position (B), and a returning spring for biasing said bulking member toward the non-bulking position on (A), and a piston outer element locking means comprises a locking member supported on said piston inner element to be moved between an operated position (C) where said locking member is in engagement in a locking groove in an inner peripheral surface of said piston outer element and a retracted position (D) where said locking member is out of engagement in said locking groove, an operating spring for biasing said locking member toward the operated position, and a hydraulically returning means operated by the hydraulic pressure from said hydraulic pressure source to operate said locking member toward the retracted position (D), so that the hydraulic pressure in said hydraulic pressure source is supplied simultaneously to said hydraulically operating means and said hydraulically returning means.

46. The compression ratio changing device in an internal combustion engine according to claim 37, wherein said actuators are disposed in a plurality of sets in a circumferential direction of said bulking member.

47. The compression ratio changing device in an internal combustion engine according to claim 46, wherein said actuators are disposed in the plurality of sets at equal distances in the circumferential direction of said bulking member.

48. The compression ratio changing device in an internal combustion engine according to claim 46, wherein said actuators are disposed in two sets on opposite sides of said piston pin.

49. The compression ratio changing device in an internal combustion engine according to claim 37, wherein said actuator comprises an operating member and a returning member which are slidably disposed in said piston inner element on the same axis extending in a direction of turning of said bulking member and are opposed to each other on opposite sides of a pressure-receiving portion of said bulking member, so that said bulking member is turned alternately to the non-bulking position (A) and the bulking position (B) by alternately operating said operating member and said returning member.

50. The compression ratio changing device in an internal combustion engine according to claim 49, wherein said operating member and said returning member comprise an operating plunger and a returning plunger, respectively, which are slidably received in a common cylinder bore defined in said piston inner element and are opposed to each other on opposite sides of said pressure-receiving portion.

51. The compression ratio changing device in an internal combustion engine according to claim 49, wherein said operating member and said returning member are disposed on the same axis intersecting, at substantially right angles a radial line of said bulking member extending through the center of said pressure-receiving portion.

52. The compression ratio changing device in an internal combustion engine according to claim 49, wherein said actuators are disposed in a plurality of sets at equal distances in a circumferential direction of said bulking member.

53. The compression ratio changing device in an internal combustion engine according to claim 49, wherein said actuators are disposed in two sets on opposite sides of said piston pin.

* * * * *